US011183162B2

(12) United States Patent
Takahashi et al.

(10) Patent No.: US 11,183,162 B2
(45) Date of Patent: Nov. 23, 2021

(54) KEYBOARD APPARATUS

(71) Applicant: YAMAHA CORPORATION, Hamamatsu (JP)

(72) Inventors: Ken Takahashi, Hamamatsu (JP); Shunsuke Ichiki, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 0 days.

(21) Appl. No.: 16/561,358

(22) Filed: Sep. 5, 2019

(65) Prior Publication Data

US 2019/0392801 A1 Dec. 26, 2019

Related U.S. Application Data

(63) Continuation of application No. PCT/JP2018/011837, filed on Mar. 23, 2018.

(30) Foreign Application Priority Data

Mar. 24, 2017 (JP) ..... JP2017-060134

(51) Int. Cl.
*G10H 1/34* (2006.01)

(52) U.S. Cl.
CPC ..... *G10H 1/344* (2013.01); *G10H 1/346* (2013.01); *G10H 2220/221* (2013.01)

(58) Field of Classification Search
CPC ... G10H 1/344; G10H 1/346; G10H 2220/221
(Continued)

(56) References Cited

U.S. PATENT DOCUMENTS 4,685,371 A * 8/1987 Levinson ..... G10C 3/24 84/239
5,585,582 A * 12/1996 Stanwood ..... G10C 3/12 84/432

(Continued)

FOREIGN PATENT DOCUMENTS

JP 2001255875 A * 9/2001 ..... G10H 1/346
JP 2001255875 A 9/2001

(Continued)

OTHER PUBLICATIONS

International Search Report issued in Intl. Appln. No PCT/JP2018/011837 dated May 22, 2018. English translation provided.

(Continued)

*Primary Examiner* — Christina M Schreiber
(74) *Attorney, Agent, or Firm* — Rossi, Kimms & McDowell LLP

(57) ABSTRACT

A keyboard apparatus includes: a frame; keys each disposed pivotably with respect to the frame; pivot members each including: a support member disposed pivotably about a pivot shaft; and a structure connected to the support member at a position spaced apart from the pivot shaft, the structure having a specific gravity that is greater than that of the support member. A hole portion is formed in each of a first structure and a second structure, each of which is the structure of a corresponding one of a first pivot member and a second pivot member of at least two of the pivot members, such that a mass of the first structure and a mass of the second structure are different from each other. The hole portion of the first structure and the hole portion of the second structure are different from each other in shape.

13 Claims, 13 Drawing Sheets

(58) Field of Classification Search
USPC ..... 84/644
See application file for complete search history.

(56) References Cited

U.S. PATENT DOCUMENTS

| | | | | |
|---|---|---|---|---|
| 5,796,024 | A * | 8/1998 | Stanwood | G10C 3/125 84/433 |
| 6,995,308 | B2 * | 2/2006 | Nishida | G10H 1/346 84/238 |
| 7,141,729 | B2 * | 11/2006 | Uno | G10H 1/346 84/236 |
| 7,345,235 | B2 * | 3/2008 | Izutani | G10C 3/12 84/720 |
| 7,538,268 | B2 * | 5/2009 | Marcus | G10C 3/00 84/723 |
| 7,678,977 | B2 * | 3/2010 | Yoshisue | G10C 3/22 84/234 |
| 7,858,863 | B2 * | 12/2010 | Osuga | G10H 1/346 84/423 R |
| 8,383,920 | B2 * | 2/2013 | Komatsu | G10H 1/346 84/17 |
| 10,636,394 | B2 * | 4/2020 | Takahashi | G10H 1/055 |
| 10,885,884 | B2 * | 1/2021 | Takahashi | B41J 5/10 |
| 2001/0037723 | A1 * | 11/2001 | Nishida | G10H 1/346 84/744 |
| 2004/0261598 | A1 * | 12/2004 | Uno | G10H 1/346 84/235 |
| 2009/0007756 | A1 * | 1/2009 | Osuga | G10H 1/346 84/423 R |
| 2015/0114202 | A1 * | 4/2015 | Suzuki | G10C 3/18 84/236 |
| 2019/0362692 | A1 * | 11/2019 | Takahashi | G10C 3/18 |
| 2019/0378486 | A1 * | 12/2019 | Kamiya | G10H 1/346 |
| 2019/0392788 | A1 * | 12/2019 | Takahashi | G10C 3/18 |
| 2019/0392801 | A1 * | 12/2019 | Takahashi | G10H 1/346 |
| 2020/0013378 | A1 * | 1/2020 | Takahashi | G10H 1/346 |

FOREIGN PATENT DOCUMENTS

| | | | | |
|---|---|---|---|---|
| JP | 2003186475 | A | 7/2003 | |
| JP | 2004020808 | A * | 1/2004 | G10H 1/346 |
| JP | 2004037484 | A | 2/2004 | |
| JP | 2004341326 | A | 12/2004 | |
| JP | 2009244507 | A * | 10/2009 | |
| JP | 2009244507 | A | 10/2009 | |
| JP | 2013076817 | A * | 4/2013 | |
| JP | 2013076817 | A | 4/2013 | |
| JP | 2015087592 | A | 5/2015 | |

OTHER PUBLICATIONS

Written Opinion issued in Intl. Appln. No. PCT/JP2018/011837 dated May 22, 2018. English translation provided.

International Preliminary Report on Patentability issued in Intl. Appln. No. PCT/JP2018/011837 dated Oct. 3, 2019. English translation provided.

* cited by examiner

KEYBOARD APPARATUS

CROSS REFERENCE TO RELATED APPLICATION

The present application is a continuation application of International Application No. PCT/JP2018/011837, filed on Mar. 23, 2018, which claims priority to Japanese Patent Application No. 2017-060134, filed on Mar. 24, 2017. The contents of these applications are incorporated herein by in their entirety.

BACKGROUND

The present disclosure relates to a keyboard apparatus. The present invention relates to a keyboard apparatus including a pivot member.

Keyboard instruments are constituted by a lot of components, resulting in a very complicated action mechanism for the components corresponding to pressing and releasing of each key. The action mechanism includes a pivot mechanism with which a lot of components are pivotably engaged.

For example, an action mechanism of an electronic keyboard instrument includes a pivot member interlocked with a key in order to simulate and give a feeling of an acoustic piano to a player via the key. Corresponding to a similar structure in an acoustic piano, this structure is usually expressed as a hammer, but the structure does not have a function of striking a string because no string is provided in the electronic keyboard instrument. In response to pressing of the key, the hammer of the electronic keyboard instrument pivots with respect to a frame so as to raise a weight provided for the hammer. The weights provided for the respective hammers respectively have different masses for the respective keys. In the electric keyboard apparatus, the mass of the weight is designed to decrease stepwise from a low-pitched sound portion toward a high-pitched sound portion, thereby reproducing touch feeling (a static load and a dynamic load) of the acoustic piano.

However, a difference in the mass of the weight is small between the hammers corresponding to close pitches, making it difficult to manufacture the weights corresponding to all the keys one by one. This leads to lower productivity of the keyboard apparatus. For example, Patent Document 1 (Japanese Patent Application Publication No. 2009-244507) discloses a keyboard apparatus including a hammer structure including one rod-like mass as a weight. Patent Document 2 (Japanese Patent Application Publication No. 2001-255875) discloses a keyboard apparatus including a hammer structure having weights at two positions located on opposite sides of the center of pivotal movement of a hammer.

SUMMARY

Patent Document 1 discloses changing the mass and the center of gravity as a weight by changing a position at which the one rod-like mass is supported or by bending the one rod-like mass. However, there is a limit to a space under the key and bending of the rod-like mass, making it difficult to freely change the mass and the center of gravity of the weight. Patent Document 2 discloses changing the mass of each of the weights at two positions located on opposite sides of the center of pivotal movement of the hammer. Changing the mass of each of the weights at two positions can control a static load and a dynamic load of the hammer structure, but the total weight of the hammer structure increases unfortunately.

Accordingly, an aspect of the disclosure relates to a technique capable of freely designing a dynamic load and a static load of each of weights of a plurality of types with a simple configuration.

In one aspect of the disclosure, a keyboard apparatus includes: a frame; a plurality of keys each disposed pivotably with respect to the frame; a plurality of pivot members each including: a support member disposed pivotably about a pivot shaft; and a structure connected to the support member at a position spaced apart from the pivot shaft, the structure having a specific gravity that is greater than that of the support member. A hole portion is formed in each of a first structure and a second structure, each of which is the structure of a corresponding one of a first pivot member and a second pivot member of at least two of the plurality of pivot members, such that a mass of the first structure and a mass of the second structure are different from each other. The hole portion of the first structure and the hole portion of the second structure are different from each other in shape.

BRIEF DESCRIPTION OF THE DRAWINGS

The objects, features, advantages, and technical and industrial significance of the present disclosure will be better understood by reading the following detailed description of the embodiment, when considered in connection with the accompanying drawings, in which.

EMBODIMENT

Figure 1:
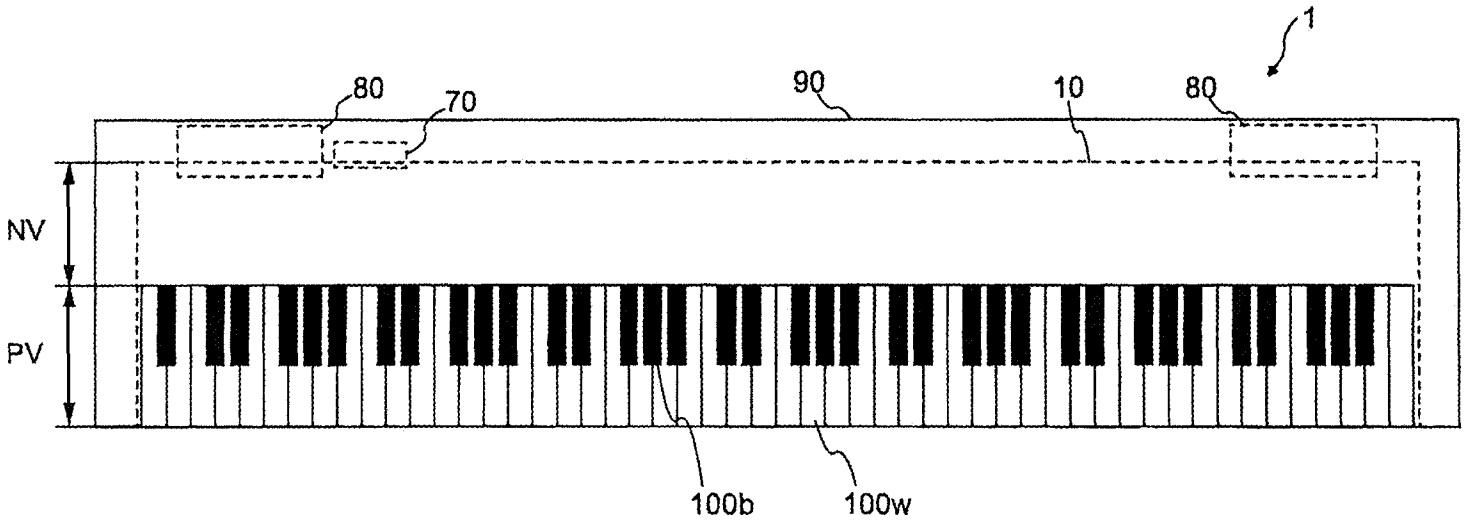
FIG. 1 is a view of a configuration of a keyboard apparatus in one embodiment.

Hereinafter, there will be described one embodiment of the present disclosure by reference to the drawings. It is to be understood that the following embodiment of the present disclosure is described by way of example, and the present disclosure should not be construed as limited to this embodiment. It is noted that the same or similar reference numerals (e.g., numbers with a character, such as A or B, appended thereto) may be used for components having the same or similar function in the following description and drawings, and an explanation of which may be dispensed with. The ratio of dimensions in the drawings (e.g., the ratio between the components and the ratio in the lengthwise, widthwise, and height directions) may differ from the actual ratio, and portions of components may be omitted from the drawings for easier understanding purposes.

Configuration of Keyboard Apparatus

FIG. 1 is a view of a configuration of a keyboard apparatus according to one embodiment. In the present example, a keyboard apparatus 1 is an electronic keyboard instrument, such as an electronic piano, configured to produce a sound when a key is pressed by a user (a player). It is noted that the keyboard apparatus 1 may be a keyboard-type controller configured to output data (e.g., MIDI) for controlling an external sound source device, in response to key pressing. In this case, the keyboard apparatus 1 may include no sound source device.

The keyboard apparatus 1 includes a keyboard assembly 10. The keyboard assembly 10 includes white keys 100*w* and black keys 100*b*. The white keys 100*w* and the black keys 100*b* are arranged side by side. The number of the keys 100 is N and 88 in this example. The number of the keys 100 is not limited to this number. A direction in which the keys 100 are arranged will be referred to as "scale direction". The white keys 100*w* and the black keys 100*b* may be hereinafter collectively referred to "the key 100" in the case where there is no need of distinction between the white keys 100*w* and the black keys 100*b*. Also in the following explanation, "w" appended to the reference number indicates a configuration corresponding to the white key. Also, "b" appended to the reference number indicates a configuration corresponding to the black key.

Here, the directions to be used in the following description (the scale direction D1 and the pivotal direction D2) will be defined. The scale direction D1 is a direction in which the keys 100 are arranged. The pivotal direction D2 corresponds to a direction in which the key pivots about a direction in which each of hammer assemblies 200 extends (i.e., a back direction when viewed by the player and a direction reverse to the D3 direction). It is noted that the pivotal direction D2 of the hammer assembly 200 substantially coincides with the pivotal direction of the key 100.

A portion of the keyboard assembly 10 is located in a housing 90. In the case where the keyboard apparatus 1 is viewed from an upper side thereof, a portion of the keyboard assembly 10 which is covered with the housing 90 will be referred to as "non-visible portion NV", and a portion of the keyboard assembly 10 which is exposed from the housing 90 and viewable by the user will be referred to as "visible portion PV". That is, the visible portion PV is a portion of the key 100 which is operable by the user to play the keyboard apparatus 1. A portion of the key 100 which is exposed by the visible portion PV may be hereinafter referred to as "key main body portion".

The housing 90 contains a sound source device 70 and a speaker 80. The sound source device 70 is configured to create a sound waveform signal in response to pressing of the key 100. The speaker 80 is configured to output the sound waveform signal created by the sound source device 70, to an outside space. It is noted that the keyboard apparatus 1 may include: a slider for controlling a sound volume; a switch for changing a tone color; and a display configured to display various kinds of information.

In the following description, up, down, left, right, front, and back (rear) directions respectively indicate directions in the case where the keyboard apparatus 1 is viewed from the player during playing. Thus, it is possible to express that the non-visible portion NV is located on a back side of the visible portion PV, for example. Also, directions may be represented with reference to the key 100. For example, a key-front-end side (a key-front side) and a key-back-end side (a key-back side) may be used. In this case, the key-front-end side is a front side of the key 100 when viewed from the player. The key-back-end side is a back side of the key 100 when viewed from the player. According to this definition, it is possible to express that a portion of the black key 100*b* from a front end to a rear end of the key main body portion of the black key 100*b* is located on an upper side of the white key 100*w*.

Figure 2:
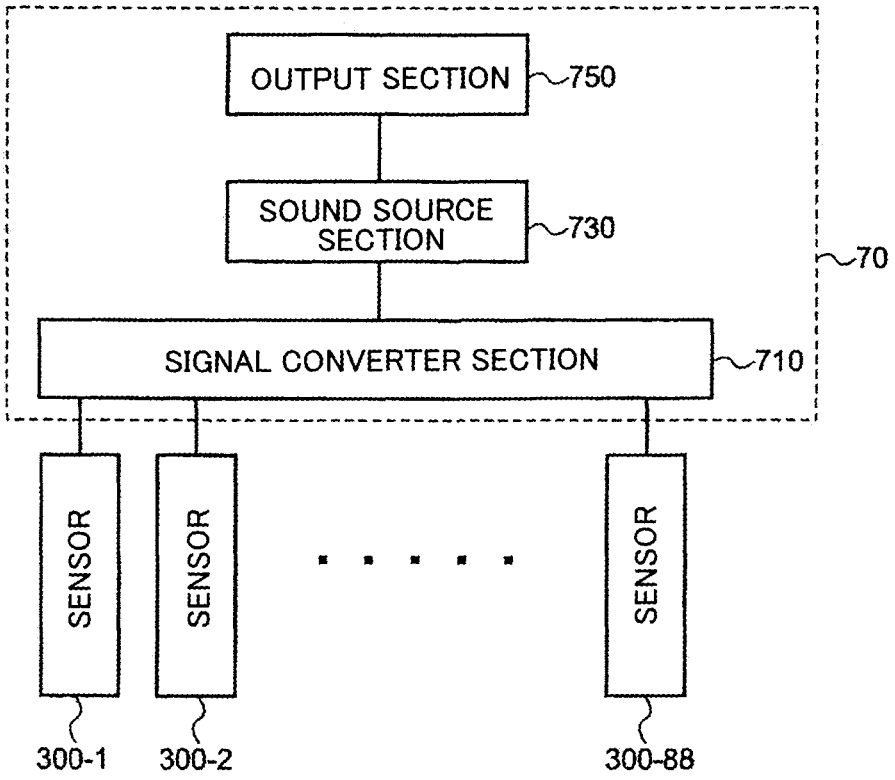
FIG. 2 is a block diagram illustrating a configuration of a sound source device in the one embodiment.

FIG. 2 is a block diagram illustrating the configuration of the sound source device in the one embodiment. The sound source device 70 includes a signal converter section 710, a sound source section 730, and an output section 750. Sensors 300 are provided corresponding to the respective keys 100. Each of the sensors 300 detects an operation of a corresponding one of the keys 100 and outputs signals in accordance with the detection. In the present example, each of the sensors 300 outputs signals in accordance with three levels of key pressing amounts. The speed of the key pressing is detectable in accordance with a time interval between the signals.

The signal converter section 710 obtains the signals output from the sensors 300 (the sensors 300-1, 300-2, . . . , 300-88 corresponding to the respective 88 keys 100) and creates and outputs an operation signal in accordance with an operation state of each of the keys 100. In the present example, the operation signal is a MIDI signal. Thus, the signal converter section 710 outputs "Note-On" when a key is pressed. In this output, a key number indicating which one of the 88 keys 100 is operated, and a velocity corresponding to the speed of the key pressing are also output in association with "Note-On". When the player has released the key 100, the signal converter section 710 outputs the key number and "Note-Off" in association with each other. A signal created in response to another operation, such as an operation on a pedal, may be output to the signal converter section 710 and reflected on the operation signal.

The sound source section 730 creates the sound waveform signal based on the operation signal output from the signal converter section 710. The output section 750 outputs the sound waveform signal created by the sound source section 730. This sound waveform signal is output to the speaker 80 or a sound-waveform-signal output terminal, for example.

Configuration of Keyboard Assembly

Figure 3:
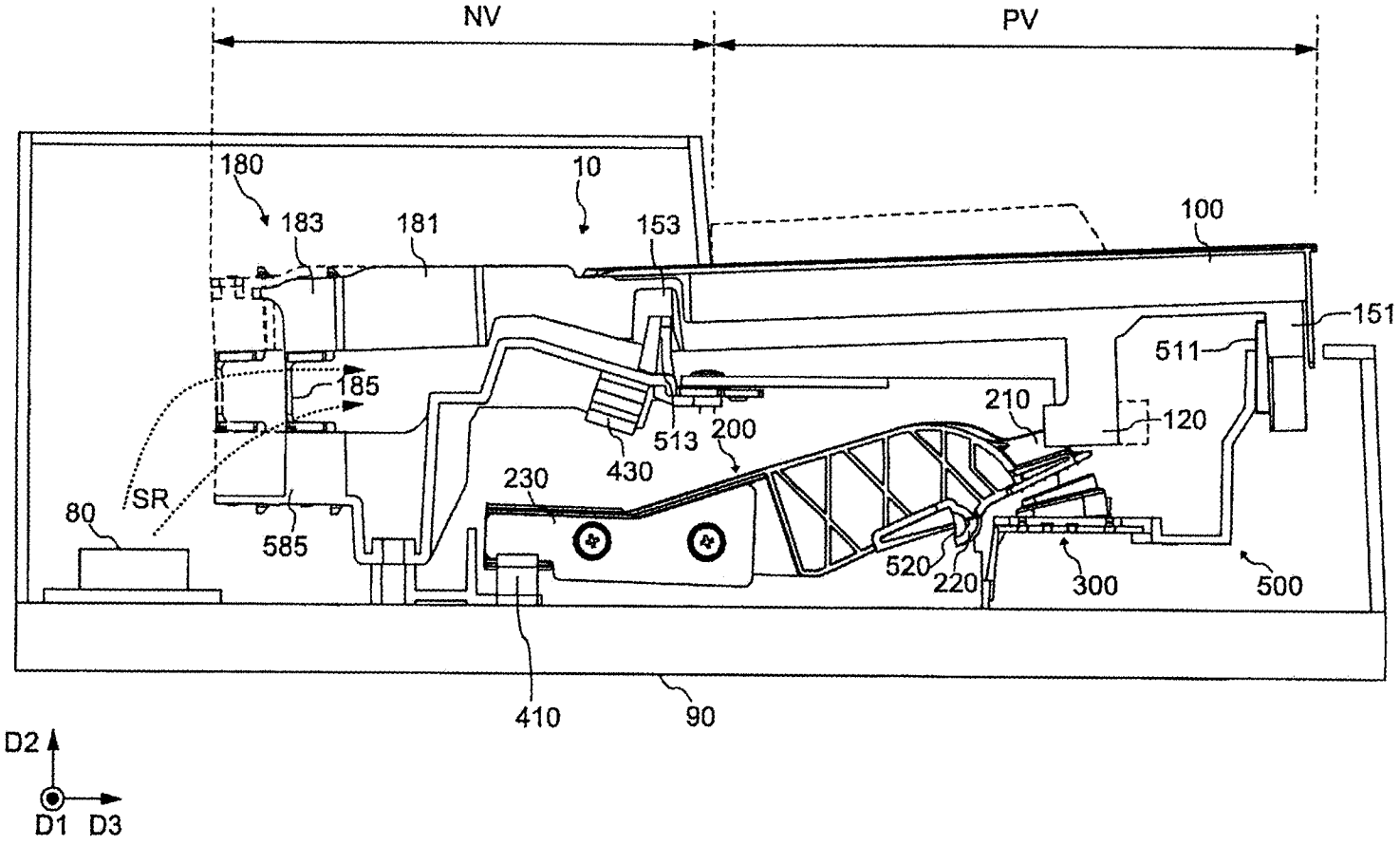
FIG. 3 is a view for explaining a configuration of the inside of a housing in the one embodiment, with the configuration viewed in a scale direction.

FIG. 3 is a view of a configuration of the inside of the housing in the one embodiment, with the configuration viewed in the scale direction. As illustrated in FIG. 3, the keyboard assembly 10 and the speaker 80 are disposed in the housing 90. That is, the housing 90 covers at least a portion of the keyboard assembly 10 (connecting portions 180 and a frame 500) and the speaker 80. The speaker 80 is disposed at a back portion of the keyboard assembly 10. This speaker 80 is disposed so as to output a sound, which is produced in response to pressing of the key 100, toward upper and lower sides of the housing 90. The sound output downward travels toward the outside from a portion of the housing 90 near its lower surface. The sound output upward passes from the inside of the housing 90 through a space in the keyboard assembly 10 and travels to the outside from a space between the housing 90 and the keys 100 or from spaces each located between adjacent two of the keys 100 at the visible portion PV. It is noted the path of a sound emitted from the speaker 80 is indicated by a path SR. Thus, the sound emitted from the speaker 80 reaches a space defined in the keyboard assembly 10, i.e., a space defined under the keys 100 (the key main body portions).

There will be next described a configuration of the keyboard assembly 10 with reference to FIG. 3. In addition to the keys 100, the keyboard assembly 10 includes the connecting portions 180, the hammer assemblies 200 (as one example of a plurality of pivot members), and the frame 500. While the key 100 of the keyboard assembly 10 is a white key (indicated by the solid lines) in FIG. 3, the black key (indicated by the broken lines) has a configuration similar to that of the white key. The keyboard assembly 10 is formed of resin, and a most portion of the keyboard assembly 10 is manufactured by, e.g., injection molding. The frame 500 is fixed to the housing 90. The connecting portions 180 connect the respective keys 100 to the frame 500 such that the keys 100 are pivotable. Each of the connecting portions 180 includes a plate-like flexible member 181, a key-side supporter 183, and a rod-like flexible member 185. The plate-like flexible member 181 extends from a rear end of the key 100. The key-side supporter 183 extends from a rear end of the plate-like flexible member 181.

Each of the rod-like flexible members 185 is supported by a corresponding one of the key-side supporters 183 and a frame-side supporter 585 of the frame 500. The key 100 pivots with respect to the frame 500 about the rod-like flexible member 185. The rod-like flexible members 185 is attachable to and detachable from the key-side supporters 183 and the frame-side supporter 585. This attachable and detachable configuration of the rod-like flexible member 185 improves easiness of manufacturing (e.g., facilitation of design of a metal mold, facilitation of assembly, and facilitation of repair) and improves touch feeling and the strength made by combination of materials, for example. It is noted that the rod-like flexible members 185 may be integral with the key-side supporters 183 and the frame-side supporter 585 or bonded thereto so as not to be attached or detached, for example.

The key 100 includes a front-end key guide 151 and a side-surface key guide 153. The front-end key guide 151 is in slidable contact with a front-end frame guide 511 of the frame 500 in a state in which the front-end key guide 151 covers the front-end frame guide 511. The front-end key guide 151 is in contact with the front-end frame guide 511 at opposite side portions of upper and lower portions of the front-end key guide 151 in the scale direction. The side-surface key guide 153 is in slidable contact with a side-surface frame guide 513 at opposite side portions of the side-surface key guide 153 in the scale direction. In the present example, the side-surface key guide 153 is disposed at portions of side surfaces of the key 100 which correspond to the non-visible portion NV, and the side-surface key guide 153 is nearer to the front end of the key 100 than the connecting portion 180 (the plate-like flexible member 181), but the side-surface key guide 153 may be disposed at a region corresponding to the visible portion PV.

A hammer supporter 120 is connected to the key 100 at a lower part of the visible portion PV. The hammer supporter is connected to the hammer assembly 200 so as to cause pivotal movement of the hammer assembly 200 while the key 100 is pivoting.

Each of the hammer assemblies 200 is disposed under a space defined under a corresponding one of the keys 100 and is pivotably attached to the frame 500. A pivot shaft 520 of the frame 500 to which the hammer assemblies 200 is attached extends in the scale direction. That is, the hammer assemblies 200 are arranged in the scale direction so as to correspond to the keys 100. The hammer assembly 200 includes a weight 230 (as one example of a structure) and a hammer body portion 205 (as one example of a support member). A bearing 220 is disposed on the hammer body portion 205. The bearing 220 and the pivot shaft 520 of the frame 500 are in slidable contact with each other at at least three points. That is, each of the hammer assemblies 200 is pivotable about the pivot shaft 520 of the frame 500. A front end portion 210 of the hammer assembly 200 is connected to the key 100 in an inner space of the hammer supporter 120 so as to be slidable substantially in the front and rear direction. This sliding portion, i.e., a load generating portion at which the front end portion 210 and the hammer supporter 120 are in contact with each other, is located under the key 100 at the visible portion PV (located in front of a rear end of the key main body portion). It is noted that the configuration of the load generating portion will be described below.

In the present embodiment, the weight 230 is constituted by a single metal weight. It is noted that the weight may be constituted by a plurality of components. The weight 230 is connected to a rear end portion of the hammer body portion 205 (on a back side of the pivot center). In a normal state (i.e., a state in which the key 100 is not pressed), the weight 230 is placed on a lower stopper 410, and the front end portion 210 of the hammer assembly 200 pushes the key 100 upward. When the key 100 is pressed, the weight 230 moves upward and comes into contact with an upper stopper 430. This defines an end position corresponding to the largest key pressing amount of the key 100. The hammer assembly 200 applies a load to key pressing by the weight 230. The lower stopper 410 and the upper stopper 430 are formed of a cushioning material (such as a nonwoven fabric and a resilient material). It is noted that the detailed configuration of the hammer assembly 200 will be described later.

The sensor 300 is attached to the frame 500 under the hammer supporter 120 and the front end portion 210. When the key 100 is pressed, a lower surface of the front end portion 210 pushes the sensor 300, causing the sensor 300 to output detection signals. As described above, the sensors 300 are provided for the respective keys 100.

Overview of Load Generating Portion

Figure 4:
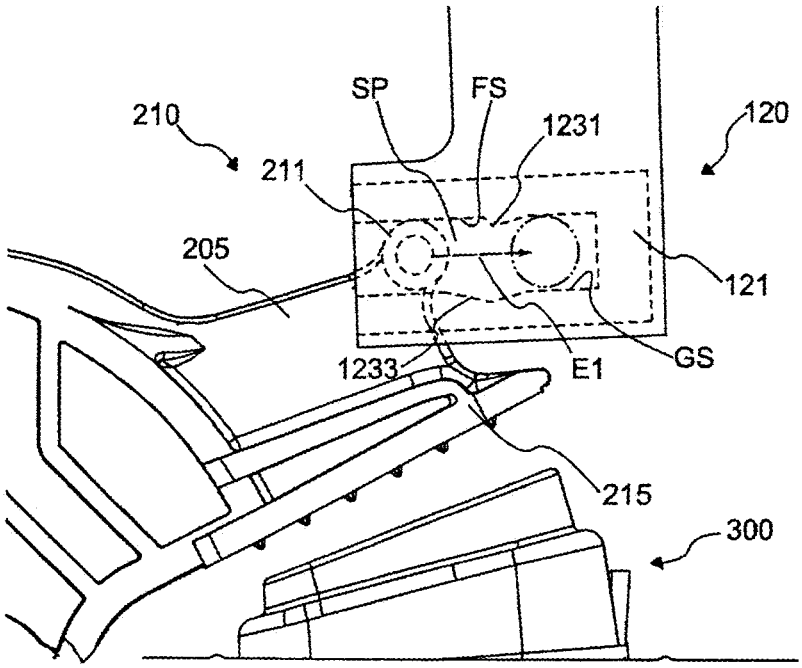
FIG. 4 is a view for explaining a configuration of a load generating portion of a keyboard assembly in the one embodiment, with the configuration viewed in the scale direction.

FIG. 4 is a view for explaining the load generating portion (the hammer supporter and the front end portion). The front end portion 210 of the hammer assembly 200 includes a force-applied portion 211 and a pressing portion 215. These components are connected to the hammer body portion 205. The hammer body portion 205 has a plate shape in this example. The force-applied portion 211 having a substantially circular cylindrical shape protrudes in a direction substantially perpendicular to the hammer body portion 205. The force-applied portion 211 is disposed in an inner space SP of the hammer supporter 120 so as to be parallel with the pivot shaft 520 of the frame 500 (the scale direction). That is, the hammer body portion 205 having the plate shape is disposed so as not to be parallel with a pivot plane but to be slightly inclined with respect to the pivot plane, to which normal coincides with the direction in which the pivot shaft 520 extends. The pressing portion 215 is provided under the front end portion 210 and has a surface with respect to the pivotal direction so as to increase the thickness of the plate shape. When the key is pressed, the pressing portion 215 is brought into contact with the sensor 300 at a position near the lower surface of the front end portion 210.

The hammer supporter 120 includes a sliding-surface forming portion 121. In this example, the sliding-surface forming portion 121 forms a space SP therein in which the force-applied portion 211 is movable. A sliding surface FS defines the upper side of the space SP, and a guide surface GS defines the lower side of the space SP. The guide surface GS has a slit through which the hammer body portion 205 passes. A region in which at least the sliding surface FS is constituted by an elastic member formed of rubber. In this example, the entire sliding-surface forming portion 121 is formed of an elastic material.

FIG. 4 illustrates the position of the force-applied portion 211 in the case where the key 100 is located at a rest position. When the key is pressed, the force-applied portion 211 is moved in the space SP in a direction indicated by arrow E1 (which may be hereinafter referred to as "travel direction E1"), while contacting the sliding surface FS. That is, the force-applied portion 211 is slid on the sliding surface FS. In this example, the sliding surface FS has a step portion 1231 formed in a region at which the force-applied portion 211 is moved by pivotal movement of the key 100 from the rest position to the end position. That is, the force-applied portion 211 moved from its initial position (the position of the force-applied portion 211 when the key 100 is located at the rest position) is moved over the step portion 1231. A recessed portion 1233 is formed at a portion of the guide surface GS which is opposed to the step portion 1231. The recessed portion 1233 makes it easy for the force-applied portion 211 to move over the step portion 1231.

When the key is pressed, a force is applied from the sliding surface FS to the force-applied portion 211. The force transmitted to the force-applied portion 211 causes pivotal movement of the hammer assembly 200 so as to move the weight 230 upward. In this movement, the force-applied portion 211 is pressed against the sliding surface FS. When the key is released, the weight 230 falls down to cause pivotal movement of the hammer assembly 200. As a result, a force is applied from the force-applied portion 211 to the sliding surface FS. Here, the force-applied portion 211 is formed of a material which causes elastic deformation less easily when compared with the material of the elastic member forming the sliding surface FS (noted that one example of the material is resin having high stiffness). Thus, when the force-applied portion 211 is pressed against the sliding surface FS, the sliding surface FS is deformed elastically. As a result, the force-applied portion 211 receives various resistance forces against movement in accordance with the pressing force.

Configuration of Hammer Assembly

Figure 5A:
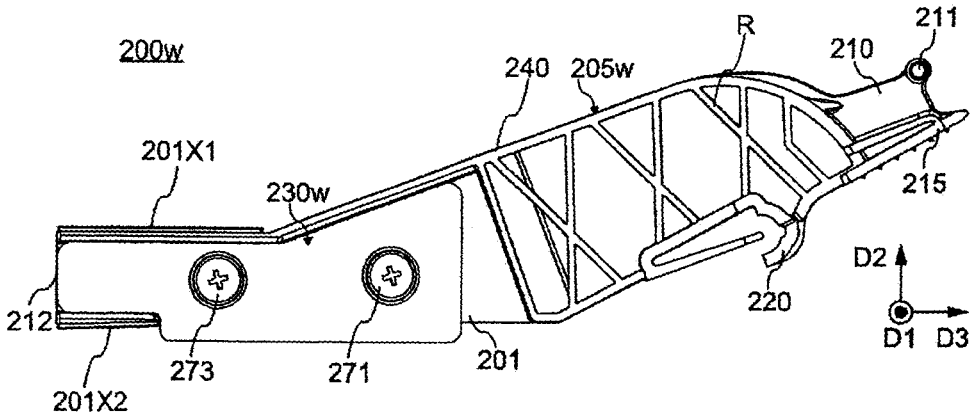
FIGS. 5A through 5C are views for explaining a detailed configuration of a hammer assembly corresponding to a white key in the one embodiment.
Figure 5B:
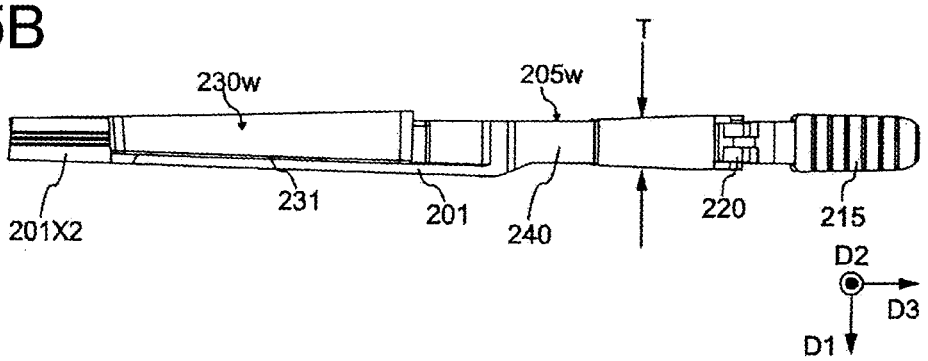
Figure 5C:
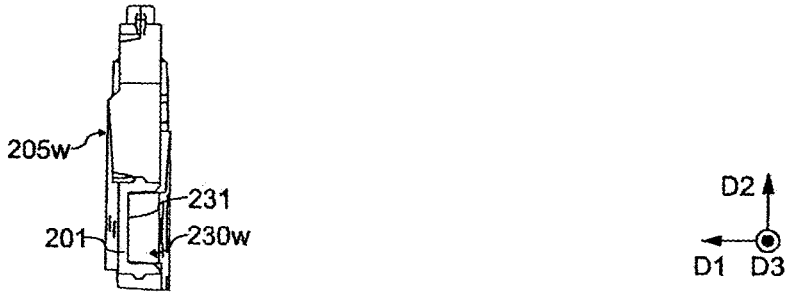

FIGS. 5A through 5C are views for explaining the hammer assembly corresponding to the white key in the one embodiment. FIG. 5A is a view of the hammer assembly viewed in the scale direction (the direction in which the pivot shaft extends and the D1 direction in FIG. 3). FIG. 5B is a view of the hammer assembly viewed from a lower side in the pivotal direction (the D2 direction in FIG. 3). FIG. 5C is a view of the hammer assembly viewed from a back side (a key-back-end side) in the direction in which the hammer assembly extends (the D3 direction in FIG. 3). It is possible to consider that the pivotal direction of the hammer assembly when the hammer assembly 200 pivots about the pivot shaft coincides with a direction (a direction parallel to the pivot plane) contained in a plane, to which normal coincides with the direction in which the pivot shaft extends (the pivot plane and a plane perpendicular to the pivot shaft). In the case where the pivotal direction is defined as described above, one example of the pivotal direction is the pivotal direction D2.

In the following description, while an explanation will be provided for a hammer assembly 200*w* corresponding to the white key, a hammer assembly 200*b* corresponding to the black key has a configuration similar to that of the hammer assembly 200*w*. The hammer assembly (the pivot member) 200*w* includes a hammer body portion (the support member) 205*w* and a weight (the structure) 230*w*. The hammer body portion 205*w* includes: the front end portion 210 including the force-applied portion 211 and the pressing portion 215; a rear end portion 212; and a connecting portion 240 connected at its one end to the front end portion 210 and at the other end to the rear end portion 212. The connecting portion 240 has the predetermined thickness T due to a rib R. A portion of the connecting portion 240 includes the bearing 220. The rear end portion 212 includes: a planar plate-like region at at least a weight mount portion 201; a first weight supporting wall 201X1 continued from the connecting portion 240 near an upper surface of the plate-like region in the pivotal direction (the D2 direction in FIG. 3); and a second weight supporting wall 201X2 opposed to the first weight supporting wall 201X1. The second weight supporting wall 201X2 is formed at a position separated from the connecting portion 240 near a rear end of the hammer assembly 200*w* and at a position near a lower surface of the pivot member in the pivotal direction (the D2 direction in FIG. 3). The weight mount portion 201 is disposed at the rear end portion 212. The weight 230 is supported so as to be interposed between the first weight supporting wall 201X1 and the second weight supporting wall 201X2. The second weight supporting wall 201X2 and the connecting portion 240 are spaced apart from each other. Thus, the weight 230 is formed so as to be exposed from between the second weight supporting wall 201X2 and the connecting portion 240 and viewable from a lower side in the pivotal direction (the D2 direction in FIG. 3). That is, the weight 230*w* is assembled to a position near the rear end and spaced apart from the pivot center (the pivot shaft). However, the present disclosure is not limited to this configuration, and the weight 230*w* at least needs to be disposed in accordance with a configuration of a keyboard to which the present disclosure is applied and at least needs to be disposed at a position nearer to a free end than the pivot center (the pivot shaft).

The hammer body portion 205*w* and the weight 230*w* are fastened to each other by a plurality of screws in this example. The weight mount portion 201 and the weight 230 are fastened to each other by a first screw 271 located near the pivot center and a second screw 273 far from the pivot center. Here, the number of the screws is not limited to two and may be one or more than two. It is noted that each of the screws is one example of a fastening member, and rivets or other similar components may be used, for example.

The weight 230*w* has at least one planar connecting surface 231 and is mounted on the weight mount portion 201 of the hammer body portion 205*w*. That is, the connecting surface 231 of the weight 230*w* and the weight mount portion 201 of the hammer body portion 205*w* are opposed and connected to each other so as to extend along the first weight supporting wall 201X1 and to be interposed between the first weight supporting wall 201X1 and the second weight supporting wall 201X2. In other words, the connecting surface 231 of the weight 230*w* is disposed along the planar plate-like region of the hammer body portion 205*w* at a position located on a side of the hammer body portion

205*w* in the scale direction (a pivot-shaft direction and the D1 direction in FIG. 3) which may be hereinafter referred to as "direction of the assembly of the weight 230 to the hammer body portion 205". It is noted that the detailed configuration of the weight 230 will be described later.

In the present embodiment, the hammer body portion 205*w* and the weight 230*w* are different from each other in properties of material. The hammer body portion 205*w* is formed of synthetic resin and manufactured by ejection molding, for example. The weight 230*w* is formed of metal and manufactured by die casting, for example. However, the materials, the manufacturing methods, and so on are not limited to those as long as the specific gravity of the weight 230*w* is greater than that of the hammer body portion 205*w*.

Configuration of Hammer Body Portion

Figure 6A:
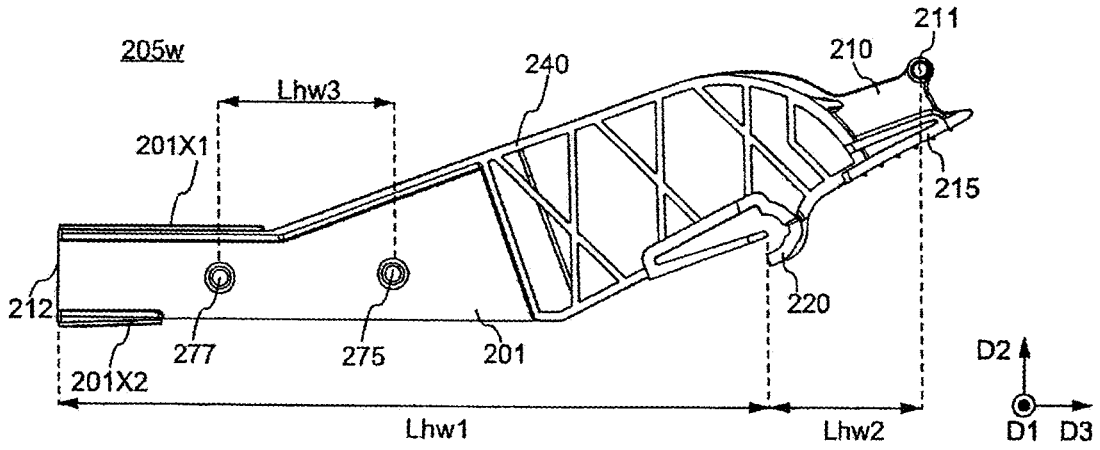
FIGS. 6A and 6B are views for explaining detailed configurations of hammer body portions in the one embodiment.
Figure 6B:
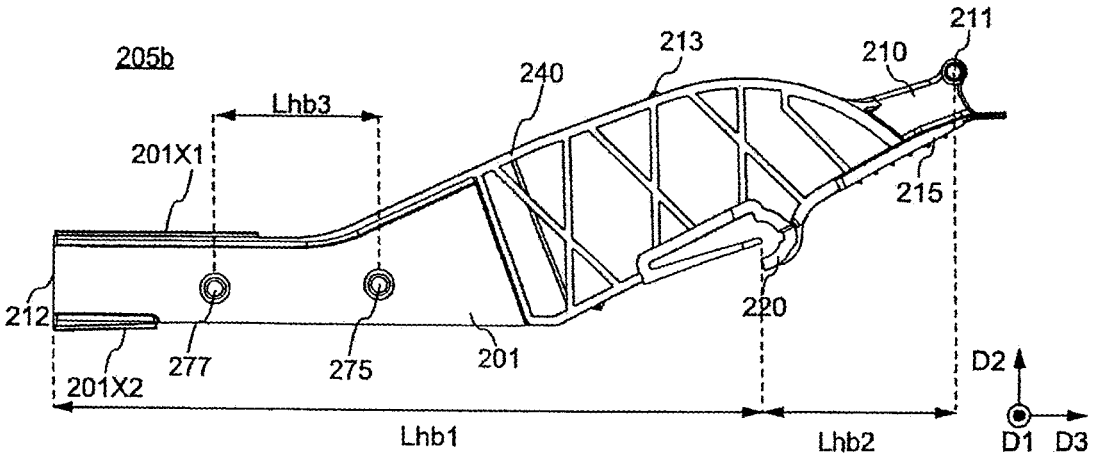

FIGS. 6A and 6B are views for explaining the hammer body portions in the one embodiment. FIG. 6A is a view of the hammer body portion 205*w* corresponding to the white key which is viewed in the scale direction (the direction in which the pivot shaft extends and the D1 direction in FIG. 3). FIG. 6B is a view of a hammer body portion 205*b* corresponding to the black key which is viewed in the scale direction (the direction in which the pivot shaft extends and the D1 direction in FIG. 3). As illustrated in FIGS. 6A and 6B, the hammer body portion 205 can be classified into at least two types including the hammer body portion 205*w* corresponding to the white key and the hammer body portion 205*b* corresponding to the black key. The distance Lhw1 from the bearing 220 to the rear end portion 212 in the hammer body portion 205*w* corresponding to the white key is equal to the distance Lhb1 from bearing 220 to the rear end portion 212 in the hammer body portion 205*b* corresponding to the black key. The distance Lhb2 from the force-applied portion 211 to the bearing 220 in the hammer body portion 205*b* corresponding to the black key is adjusted so as to be greater than the distance Lhw2 from the force-applied portion 211 to the bearing 220 in the hammer body portion 205*w* corresponding to the white key. That is, the distance (Lhb1+Lhb2) from the force-applied portion 211 to the rear end portion 212 in the hammer body portion 205*b* corresponding to the black key is adjusted so as to be greater than the distance (Lhw1+Lhw2) from the force-applied portion 211 to the rear end portion 212 in the hammer body portion 205*w* corresponding to the white key. Each of the weights 230 is secured with respect to the rear end portion 212 of a corresponding one of the hammer body portions 205. Thus, the distance from the force-applied portion 211 to the end of the weight 230 near the rear end portion 212 in the hammer assembly 200 corresponding to the black key is adjusted so as to be greater than the distance from the force-applied portion 211 to the end of the weight 230 near the rear end portion 212 in the hammer assembly 200 corresponding to the white key. In the present embodiment, the number of the hammer body portions 205*w* corresponding to the respective white keys is 52, and the number of the hammer body portions 205*b* corresponding to the respective black keys is 36, but the present disclosure is not limited to these numbers. The hammer body portions 205 are of one type for the white keys and one type for the black keys, but the number of the types of the hammer body portions 205 is not limited to this number. For example, the hammer body portions 205 may be of one type or three or more types.

Since the hammer body portion 205*w* corresponding to the white key and the hammer body portion 205*b* corresponding to the black key are different from each other, the hammer body portion 205*w* and the hammer body portion 205*b* are different from each other in distance between a first screw holder 275 corresponding to the first screw 271 and a second screw holder 277 corresponding to the second screw 273 in order to prevent wrong connection of the weight 230. In this example, the distance Lhb3 from the first screw holder 275 to the second screw holder 277 in the hammer body portion 205*b* corresponding to the black key is adjusted so as to be less than the distance Lhw3 from the first screw holder 275 to the second screw holder 277 in the hammer body portion 205*w* corresponding to the white key. Screw through holes of the weight 230 which will be described below has a positional relationship similar to the above-described positional relationship. However, the present disclosure is not limited to this configuration. The distance from the first screw holder 275 to the second screw holder 277 may be reversed between the hammer body portion 205*w* corresponding to the white key and the hammer body portion 205*b* corresponding to the black key. The number of the screw holders may be different between the hammer body portion 205*w* corresponding to the white key and the hammer body portion 205*b* corresponding to the black key. Each of the weights 230 corresponding to the respective hammer body portions 205 at least needs to have the screw through holes corresponding to the distance and/or the number of the screw holders. Since the hammer body portion 205 and the weight 230 respectively have the screw holders and the screw through holes corresponding to each combination, it is possible to prevent wrong connection between the hammer body portion 205 and the weight 230, resulting in improved productivity.

A hammer identifier 213 may be provided to easily distinguish between the hammer body portion 205*w* corresponding to the white key and the hammer body portion 205*b* corresponding to the black key. In this example, the hammer identifier 213 having a protruding shape is disposed on an upper surface of the hammer body portion 205*b* corresponding to the black key in the pivotal direction. While the hammer identifier 213 is shaped like a rib protruding from the upper surface in the pivotal direction, the present disclosure is not limited to this shape. The hammer identifier 213 may have any shape as long as pivotal movement of the hammer assembly 200*b* is not limited. Since the hammer identifier 213 is provided, it is possible to easily distinguish between the hammer body portion 205*w* corresponding to the white key and the hammer body portion 205*b* corresponding to the black key. This prevents erroneous identification between the hammer body portions of the two types, resulting in improved productivity.

Configuration of Weight

Figure 7A:
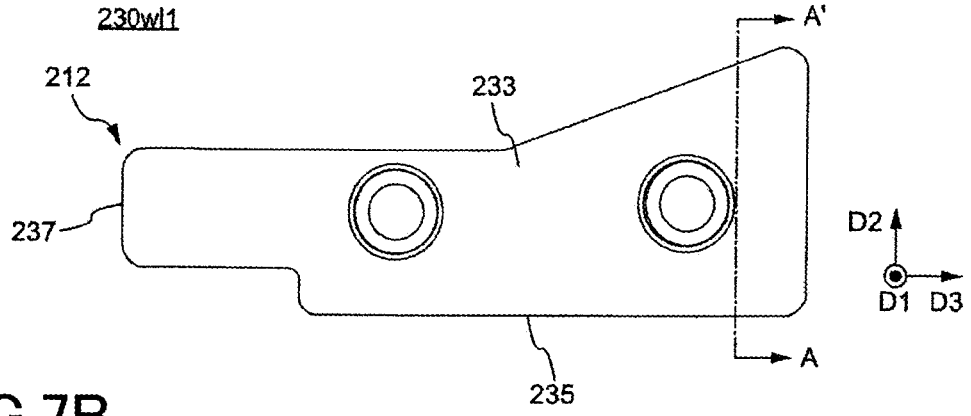
FIGS. 7A through 7D are views for explaining a detailed configuration of a weight in the one embodiment.

There will be next described the detailed configuration of the weight with reference to FIGS. 7A-8C. FIGS. 7A-8C are views for explaining the weights in the one embodiment. FIG. 7A is a view of a weight 230*wl*1 corresponding to a low-pitched-sound white key which is viewed in the scale direction (the direction in which the pivot shaft extends and the D1 direction in FIG. 3). FIG. 7B is a view of the weight 230*wl*1 viewed from a lower-surface side in the pivotal direction of the hammer assembly (the D2 direction in FIG. 3). FIG. 7C is a view of the weight 230*wl*1 viewed in the direction in which the hammer assembly extends (the direction from the front side toward the back side when viewed from the player in the state in which the hammer assembly is assembled to the keyboard apparatus, and the direction reverse to the D3 direction in FIG. 3). FIG. 7D is a cross-sectional view taken along line A-A', illustrating a weight 230*wl* corresponding to a low-pitched-sound-side first white key which is viewed in the direction in which the hammer assembly 200 extends (the direction from the back side toward the front side when viewed from the player in the state in which the hammer assembly is assembled to the keyboard apparatus, and the D3 direction in FIG. 3).

Figure 8A:
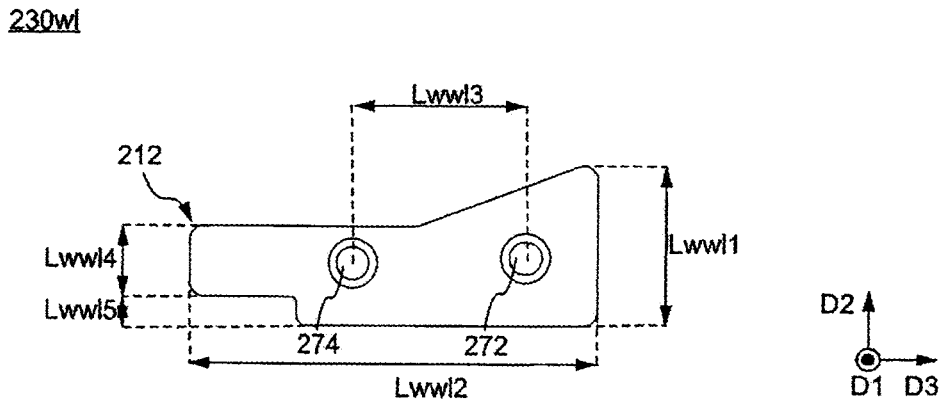
FIGS. 8A through 8C are views for explaining detailed configurations of the weights in the one embodiment.
Figure 8B:
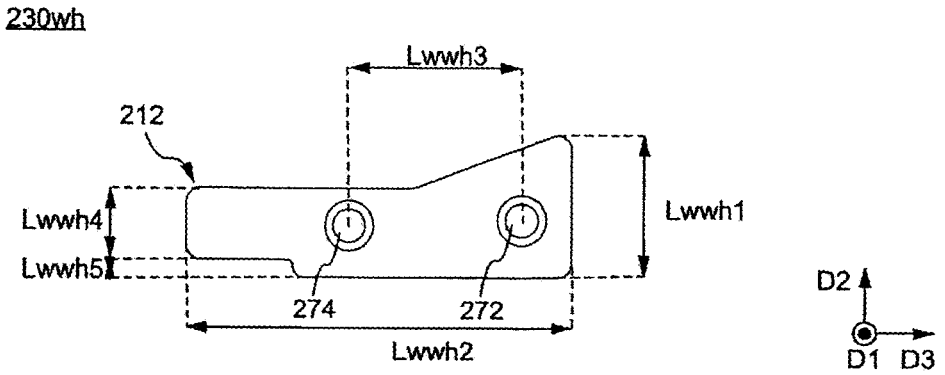
Figure 8C:
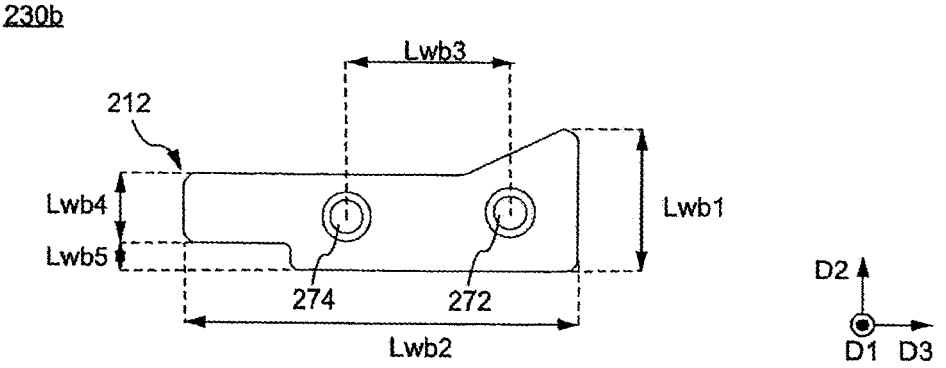

FIG. 8A is a view of the weight 230*wl* corresponding to the low-pitched-sound white key which is viewed in the scale direction (the pivot-shaft direction and the D1 direction in FIG. 3). FIG. 8B is a view of a weight 230*wh* corresponding to the high-pitched-sound white key which is viewed in the scale direction (the direction in which the pivot shaft extends and the D1 direction in FIG. 3). FIG. 8C is a view of a weight 230*b* corresponding to the black key which is viewed in the scale direction (the direction in which the pivot shaft extends and the D1 direction in FIG. 3). As illustrated in FIGS. 8A-8C, the external dimension (the outer shape) of the weight 230 is different among the weight 230*wl* corresponding to the low-pitched-sound white key, the weight 230*wh* corresponding to the high-pitched-sound white key, and the weight 230*b* corresponding to the black key and can be classified into at least three types.

In a portion of the hammer assembly which is located near the rear end portion 212 (the back direction when viewed from the player in the state in which the hammer assembly is assembled to the keyboard apparatus and the direction reverse to the D3 direction in FIG. 3), the smallest distance Lwwl4 in the pivotal direction D2 on the weight 230*wl* corresponding to the low-pitched-sound white key, the smallest distance Lwwh4 in the pivotal direction D2 on the weight 230*wh* corresponding to the high-pitched-sound white key, and the smallest distance Lwb4 in the pivotal direction D2 on the weight 230*b* corresponding to the black key are substantially the same as each other. That is, the external dimension (the outer shape) is substantially the same at a rear end portion of the weight 230 which is interposed between the first weight supporting wall 201X1 and the second weight supporting wall 201X2 of the hammer body portion 205.

In a portion of the hammer assembly which is located near the pivot shaft (the front direction when viewed from the player in the state in which the hammer assembly is assembled to the keyboard apparatus, and the D3 direction in FIG. 3), the largest distance Lwwl1 in the pivotal direction D2 on the weight 230*wl* corresponding to the low-pitched-sound white key, the largest distance Lwwh1 in the pivotal direction D2 on the weight 230*wh* corresponding to the high-pitched-sound white key, the largest distance Lwb1 in the pivotal direction D2 on the weight 230*b* corresponding to the black key are different from each other. The distance Lwb1 is adjusted to be greater than the distance Lwwh1, and the distance Lwwl1 is adjusted to be greater than the distance Lwb1. The largest distance Lwwl2 on the weight 230*wl* corresponding to the low-pitched-sound white key in the direction D3 in which the hammer assembly extends, the largest distance Lwwh2 on the weight 230*wh* corresponding to the high-pitched-sound white key in the direction D3 in which the hammer assembly extends, and the largest distance Lwb2 on the weight 230*b* corresponding to the black key in the direction D3 in which the hammer assembly extends are different from each other. The distance Lwb2 is adjusted to be greater than the distance Lwwh2, and the distance Lwwl2 is adjusted to be greater than the distance Lwb2.

The weight 230 is exposed from between the second weight supporting wall 201X2 and the connecting portion 240 of the hammer body portion 205 and protrudes toward the lower surface in the pivotal direction (the direction reverse to the D2 direction in FIG. 3). The protruding distance Lwwl5 in the pivotal direction D2 on the weight 230*wl* corresponding to the low-pitched-sound white key is substantially equal to the protruding distance Lwb5 in the pivotal direction D2 on the weight 230*b* corresponding to the black key. Each of the protruding distance Lwwl5 in the pivotal direction D2 on the weight 230*wl* corresponding to the low-pitched-sound white key and the protruding distance Lwb5 in the pivotal direction D2 on the weight 230*b* corresponding to the black key is different from the protruding distance Lwwh5 in the pivotal direction D2 on the weight 230*wh* corresponding to the high-pitched-sound white key. Each of the distance Lwwl5 and the distance Lwb5 protrudes toward the lower surface in the pivotal direction (the direction reverse to the D2 direction in FIG. 3) by an amount greater than that of the distance Lwwh5.

Figure 7B:
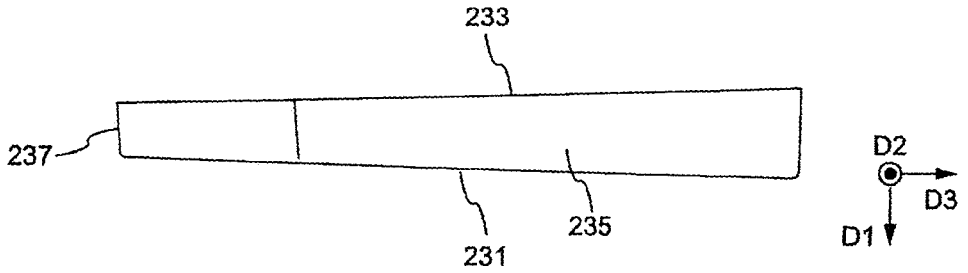
Figure 7C:
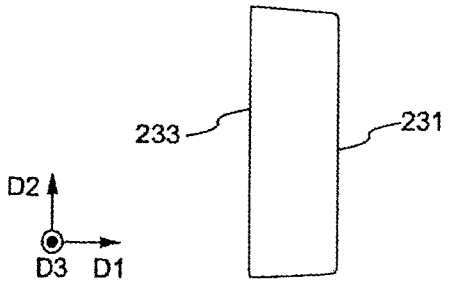
Figure 7D:
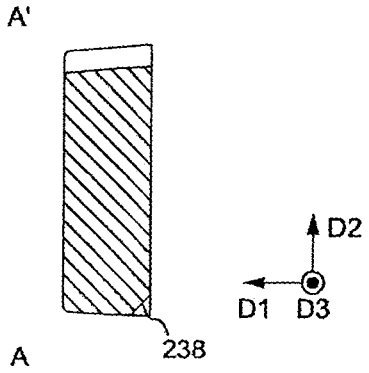

Though not illustrated in FIGS. 8A-8C, the distance in the scale direction D1 at a portion of the hammer assembly near the rear end portion 212 is the same among the weight 230*wl* corresponding to the low-pitched-sound white key, the weight 230*wh* corresponding to the high-pitched-sound white key, and the weight 230*b* corresponding to the black key. As illustrated in FIG. 7B, the distance of the weight 230*wl* in the thickness direction D1 has a gradient so as to increase with change in position in the direction in which the hammer assembly extends (the direction from the back side toward the front side when viewed from the player in the state in which the hammer assembly is assembled to the keyboard apparatus, and the D3 direction in FIG. 3). The distance of each of the weight 230*wh* and the weight 230*b* in the thickness direction D1 has the same gradient as the distance of the weight 230*wl* in the thickness direction D1. Since the largest distance in the direction D3 in which the hammer assembly extends is different among the weight 230*wl*, the weight 230*wh*, and the weight 230*b*, the largest distance in the scale direction D1 is also different among the weight 230*wl*, the weight 230*wh*, and the weight 230*b*. The distance of each of the weight 230*wl*, the weight 230*wh*, and the weight 230*b* in the scale direction D1 at a portion of the hammer assembly near the pivot center (a front side when viewed from the player) is adjusted so as to be greater in the weight 230*b* than in the weight 230*wh* and greater in the weight 230*wl* than in the weight 230*b*.

As described above, the external dimension (the outer shape) is different among the weight 230*wl* corresponding to the low-pitched-sound white key, the weight 230*wh* corresponding to the high-pitched-sound white key, and the weight 230*b* corresponding to the black key. The mass of the weight 230*wl* corresponding to the first white key from a low-pitched-sound side not containing a recessed portion which will be described below is greater than the mass of the weight 230*b* corresponding to the first black key from the low-pitched-sound side. The mass of the weight 230*b* corresponding to the first black key from the low-pitched sound side is greater than the mass of the weight 230*wh* corresponding to the twenty-fifth high-pitched-sound white key from the low-pitched-sound side.

The number of the weights 230*wl* corresponding to the low-pitched-sound white keys is 25, the number of the weights 230*wh* corresponding to the high-pitched-sound white keys is 27, and the number of the weights 230*b* corresponding to the black keys is 36, but the present disclosure are not limited to these numbers. While the weights 230 have the external dimensions (the outer shapes) corresponding to the two types of the white keys and the one type of the black key, the present disclosure is not limited to this number of types. For example, the keys may be of two types: one type for the white key and one type for the black key, and the keys may be of three or more types.

Figure 9:
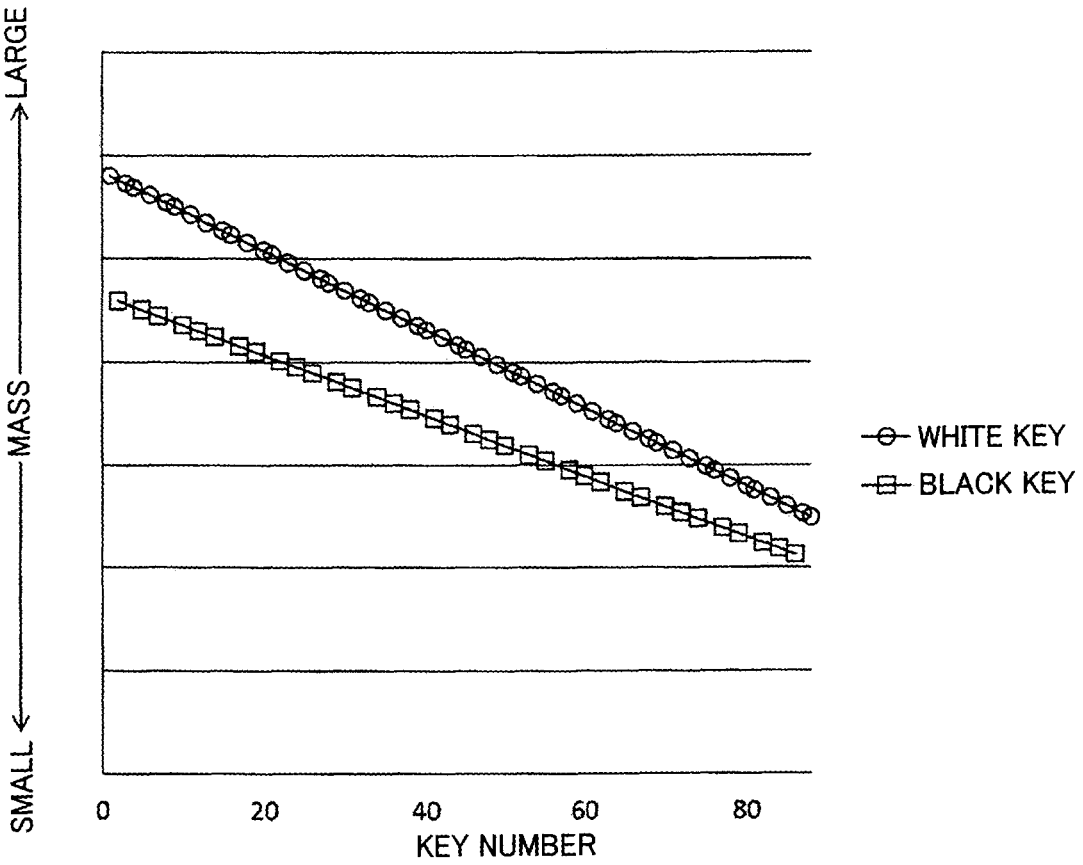
FIG. 9 is a view illustrating a relationship between the pitch corresponding to each key and the mass of the weight in the one embodiment.

FIG. 9 is a view representing a relationship between the pitch corresponding to each key and the mass of the weight in the one embodiment. As illustrated in FIG. 9, the different weights 230 corresponding to the respective keys have different masses, and the weights 230 are arranged in descending order of weight from a low-pitched sound portion toward a high-pitched sound portion in order of pitch. The mass of the weight 230 with respect to the pitch always changes linearly at the constant rate from the low-pitched sound portion to the high-pitched sound portion. However, the present disclosure is not limited to this, and the mass of the weight 230 with respect to the pitch may change non-linearly. In the present embodiment, since the distance Lhw2 from the force-applied portion 211 to the bearing 220 in the hammer body portion 205*w* corresponding to the white key is different from the distance Lhb2 from the force-applied portion 211 to the bearing 220 in the hammer body portion 205*b* corresponding to the black key, a relationship between the pitch and the mass of the weight in each of the weight 230*wl* corresponding to the low-pitched-sound white key and the weight 230*wh* corresponding to the high-pitched-sound white key is independent of a relationship between the pitch and the mass of the weight in the weight 230*b* corresponding to the black key. By adjusting the distance from the force-applied portion 211 to the bearing 220 in the hammer body portion 205 and the mass of the weight 230 and the center of gravity, it is possible to set static loads and dynamic loads stepwise from the low-pitched sound portion toward the high-pitched sound portion through the white keys and the black keys as described later. It is noted that since the mass of the hammer body portion 205 is considerably smaller than that of the weight 230, the mass and the center of gravity of the hammer assembly 200 are substantially the same as the mass and the center of gravity of the weight 230, respectively.

Figure 10A:
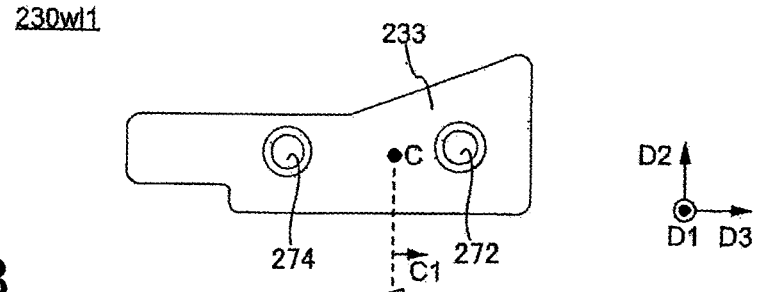
FIGS. 10A through 10E are views for explaining the detailed configuration of the weights in the one embodiment.
Figure 10B:
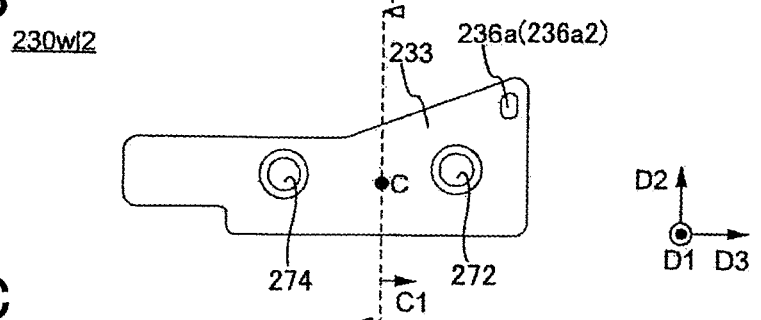
Figure 10C:
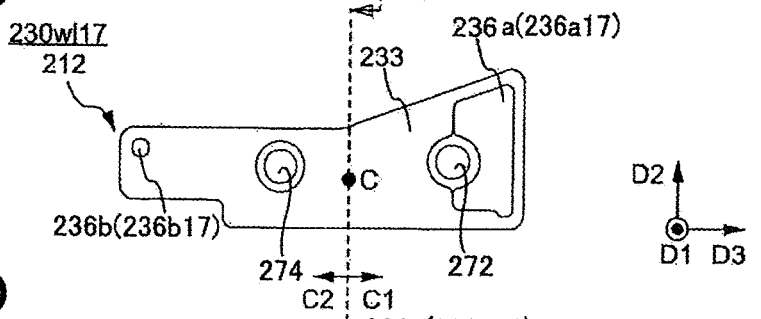
Figure 10D:
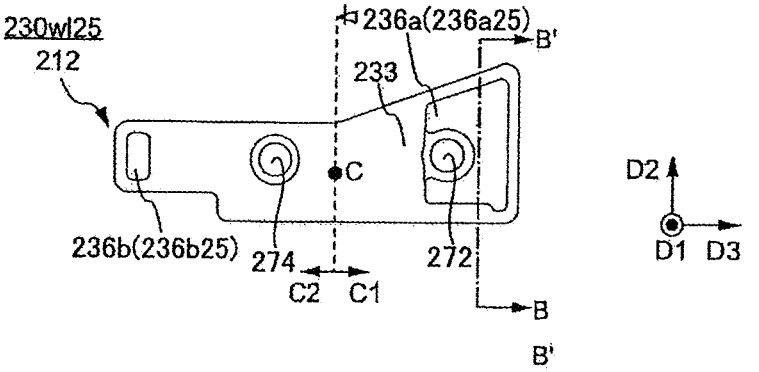
Figure 10E:
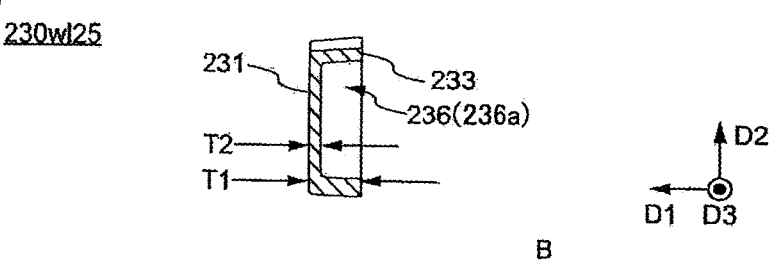

FIGS. 10A-10E are views for explaining the weights in the one embodiment. FIG. 10A is a view of the weight 230*wl*1 corresponding to the lowest-pitched-sound white key which is viewed in the direction of the assembly of the weight 230 to the hammer body portion 205 (the direction in which the pivot shaft extends and the D1 direction in FIG. 3). FIG. 10B is a view of a weight 230*wl*2 corresponding to the low-pitched-sound-side second white key which is viewed in the direction of the assembly of the weight 230 to the hammer body portion 205 (the direction in which the pivot shaft extends and the D1 direction in FIG. 3). FIG. 10C is a view of a weight 230*wl*7 corresponding to the low-pitched-sound-side seventeenth white key which is viewed in the direction of the assembly of the weight 230 to the hammer body portion 205 (the direction in which the pivot shaft extends and the D1 direction in FIG. 3). FIG. 10D is a view of a weight 230*wl*25 corresponding to the low-pitched-sound-side twenty-fifth white key which is viewed in the direction of the assembly of the weight 230 to the hammer body portion 205 (the direction in which the pivot shaft extends and the D1 direction in FIG. 3). FIG. 10E is a cross-sectional view of the weight 230*wl*25 corresponding to the low-pitched-sound-side twenty-fifth white key, taken along line B-B'. As illustrated in FIGS. 10C-10E, since the weights 230*wl* having the same external dimension are formed so as to have different masses, the weight 230*wl* includes a recessed portion 236 on a surface different from the connecting surface 231 connected to the hammer body portion 205. It is noted that an explanation will be provided for the weight 230*wl* corresponding to the low-pitched-sound white key, but the same configuration may be applied to the weight 230*wh* corresponding to the high-pitched-sound white key and the weight 230*b* corresponding to the black key. It is noted that the weight 230*wl*1 (as one example of a third structure) in FIG. 10A does not include a first recessed portion 236*a* which will be described below and a second recessed portion 236*b* which will be described below. While the recessed portion 236 is a recessed portion not formed through the weight 230 in the thickness direction in the present embodiment as illustrated in FIG. 10E, the recessed portion may be formed through the weight 230 in the thickness direction in shape.

While FIGS. 10A-10E illustrate the weights 230*wl* corresponding to the four low-pitched-sound white keys by way of example, the external dimensions (the outer shapes) of all of the weights 230*wl* corresponding to the twenty-five low-pitched-sound white keys are the same as each other. In the case where numbers 1-25 are assigned respectively to the twenty-five low-pitched-sound-side white keys in order from the low-pitched-sound side, the weight 230*wl*1 corresponding to the lowest-pitched-sound white key is the heaviest, and the weight 230*wl*25 corresponding to the low-pitched-sound-side twenty-fifth white key is the lightest. That is, the masses of the weights 230*wl* corresponding to the respective twenty-five low-pitched-sound white keys are different from each other, forming a mass gradient. Since this mass gradient is formed, the recessed portion 236 formed at a surface 233 of the weight 230*wl* which is opposed to the connecting surface 231 connected to the hammer body portion 205 is different in shape among the weights 230*wl*. In other words, since the different weights 230*wl* have the recessed portions 236 with the different shapes, respectively, the different weights 230*wl* have the different masses, respectively, even in the case where the weights 230*wl* have the same external dimension (the same outer shape). Each of the weights 230*wl*7, 230*wl*25 has two recessed portion 236, namely, the first recessed portion 236*a* and the second recessed portion 236*b*. While each of the weight 230*wl*7 and the weight 230*wl*25 is the weight 230*wl* corresponding to the white key 100*w*, the weight 230*wl* corresponding to the black key 100*b* may have the two recessed portions 236*a*, 236*b*.

It is noted that the weight 230*wl*25 corresponding to the twenty-fifth low-pitched-sound white key from the low-pitched-sound side is adjusted so as to be heavier than a weight 230*wh*1 corresponding to the twenty-sixth high-pitched-sound white key from the low-pitched-sound side. As illustrated in FIG. 9, the weights 230*wl* corresponding to the twenty-five low-pitched-sound white keys and the weights 230*wh* corresponding to the twenty-seven high-pitched-sound white keys have a linear relationship between the pitch and the mass of the weight of the white key. Since the recessed portions 236 are formed, even in the case where the weights 230 have the same external dimension or different external dimensions, the weights 230 corresponding to the respective keys can be adjusted such that the weight of the weight 230 decreases stepwise from the low-pitched sound portion toward the high-pitched sound portion in order of pitch.

A plurality of the recessed portions 236 may be formed in each of the weights 230*wl* (noted that the plurality of recessed portions may be hereinafter referred to as the recessed portions 236 in the case where no distinction is provided among the plurality of recessed portions). In the state in which the weight is assembled to the hammer body portion 205, the first recessed portion (as one example of a first hole portion) 236*a* is disposed near the bearing 220

(nearer to the pivot center) in the longitudinal direction of the weight (in the D3 direction in FIGS. 10A-10E). The first recessed portion 236*a* is formed in the weight 230*wl* so as to include at least a portion of a region located on a pivot-shaft side (a C1-direction side) of the center of gravity C of the weight 230*wl* (a region nearer to the pivot shaft than the center of gravity C). That is, as long as the region in which the first recessed portion 236*a* is disposed includes at least a portion of the region located on the pivot-shaft side of the center of gravity C of the weight 230*wl*, the region in which the first recessed portion 236*a* is disposed may include the center of gravity of the weight 230*wl* and may include at least a portion of a region located on an opposite side (a C2-direction side) of the center of gravity C of the weight 230*wl* from the pivot shaft. At least a portion of the first recessed portion 236*a* is disposed at a position nearer to the pivot shaft than a first screw through hole 272 and a second screw through hole 274 which will be described below. Since the different weights 230*wl* respectively have the first recessed portions 236*a* of different sizes at a position near the pivot shaft as described above, the moment about the pivot center which is applied from gravity to the hammer assembly 200 effectively works with different properties. That is, the shape or the size of a first recessed portion 236*a*2 of the weight 230*wl*2 (as one example of a first structure) (the area of the recessed portion of the first recessed portion 236*a*2 when viewed in the direction in which the pivot shaft extends (the opening area)) is different from the shape or the size of a first recessed portion 236*a*17 of the weight 230*wl*7 (as one example of a second structure), and the shape or the size of the first recessed portion 236*a*2 of the weight 230*wl*7 is different from the shape or the size of a first recessed portion 236*a*25 of the weight 230*wl*25 (as one example of the first structure). The moment about the pivot center which is applied from gravity to the hammer assembly 200 determines a static load of the keyboard apparatus which will be described below.

FIG. 10E is a cross-sectional view taken along line B-B', illustrating the weight 230*wl*25 corresponding to the low-pitched-sound-side twenty-fifth white key which is viewed in the direction in which the hammer assembly 200 extends (the direction from the back side toward the front side when viewed from the player, and the D3 direction in FIG. 3). As illustrated in FIG. 10E, the weight 230*wl*25 is adjusted such that the distance T2 of the region in the recessed portion 236 in the thickness direction (the direction in which the pivot shaft extends and the D1 direction in FIG. 3) is less than the distance T1 of the other region in the thickness direction. The distance T2 in the thickness direction is substantially the same in the region of the recessed portion 236 of the weight 230*wl*. As illustrated in FIGS. 10B-10D, the different recessed portions 236 of the respective weights 230*wl* have different sizes (the different areas (opening areas) of the first recessed portion 236*a*) when viewed in the direction of the assembly of the weight 230 to the hammer body portion 205 (the direction in which the pivot shaft extends and the D1 direction in FIG. 3). The mass of the weight 230*wl* decreases in inverse proportion to the size of the recessed portion 236 of the weight 230*wl* when viewed in the direction of assembly of the weight 230 to the hammer body portion 205 (the pivot-shaft direction and the D1 direction in FIG. 3). In the weights 230 having the same external dimension (outer shape), the size of the recessed portion 236 when viewed in the direction of assembly of the weight 230 to the hammer body portion 205 (the direction in which the pivot shaft extends and the D1 direction in FIG. 3) increases from the low-pitched sound portion toward the high-pitched sound portion in order of pitch. Since the weights 230 corresponding to the respective keys have the above-described recessed portions 236, the mass of the weight 230 decreases from the low-pitched sound portion toward the high-pitched sound portion in order of pitch.

The first recessed portion 236*a* of each of the weights 230 is disposed in the surface 233 opposed to the connecting surface 231, on a pivot-center side (a front side when viewed from the player). In the weights 230, the size of the first recessed portion 236*a* in the direction in which the hammer assembly 200 extends (the direction from the front side toward the back side when viewed from the player in the state in which the hammer assembly 200 is assembled to the keyboard apparatus) increases with increase in the size of the recessed portion 236 when viewed in the direction in which the weight 230 is assembled to the hammer body portion 205 (the pivot-shaft direction and the D1 direction in FIG. 3). However, the present disclosure is not limited to this. For example, as illustrated in FIGS. 10C and 10D, a plurality of the recessed portions 236 may be formed. The recessed portions 236 may be arranged on an opposite side (the C2-direction side) of the center of gravity C of the hammer assembly 200 from the pivot center (the pivot shaft) so as to be nearer to the rear end portion 212. A plurality of the first recessed portions 236*a* may be arranged at positions nearer to the pivot shaft than the center of gravity C. The second recessed portion (a second hole portion) 236*b* disposed nearer to the rear end portion 212 of the hammer assembly 200 is located at a position farther from the pivot center (the pivot shaft) than the first recessed portion 236*a*. That is, the distance between the pivot shaft and the second recessed portion 236*b* (as one example of a second distance) is greater than the distance between the pivot shaft and the first recessed portion 236*a* (as one example of a first distance). The second recessed portion 236*b* is disposed so as to include at least a portion of a region located on an opposite side (the C2-direction side) of the center of gravity C of the weight 230*wl* from the pivot shaft. As long as the second recessed portion 236*b* does not overlap the first recessed portion 236*a*, the second recessed portion 236*b* is disposed so as to include at least a portion of a region located on an opposite side (the C2-direction side) of the center of gravity C of the weight 230*wl* from the pivot shaft. That is, as long as the region in which the second recessed portion 236*b* is disposed includes at least a portion of a region located on an opposite side (the C2-direction side) of the center of gravity C of the weight 230*wl* from the pivot shaft, the region in which the second recessed portion 236*b* is disposed may further include the center of gravity of the weight 230*wl* and may further include a region located nearer to the pivot shaft than the center of gravity C of the weight 230*wl* (the C1-direction side). In the above-described description, the wordings "as long as the second recessed portion 236*b* does not overlap the first recessed portion 236*a*" are used, but as long as the mass and the center of gravity can be adjusted as desired, even a configuration in which the first recessed portion 236*a* and the second recessed portion 236*b* are connected to each other by a shallow groove, a narrow groove, or the like does not depart from the spirit and scope of the present invention. It is noted that at least a portion of the second recessed portion 236*b* is disposed at a position farther from the pivot shaft than the first screw through hole 272 and the second screw through hole 274 which will be described below.

Like the first recessed portion 236*a* disposed nearer to the pivot center of the hammer assembly 200, the second recessed portion (the second hole portion) 236*b* illustrated in FIGS. 10C and 10D is adjusted such that the distance T2 of the region in the recessed portion 236 in the thickness direction (the pivot-shaft direction and the D1 direction in FIG. 3) is less than the distance T1 of the other region in the thickness direction. The distance T2 in the region in the thickness direction is substantially the same among the plurality of recessed portions 236 (the first recessed portion 236*a* and the second recessed portion 236*b*) of the weight 230*wl*. The distance of each of the weights 230*wl* in the thickness direction D1 has a gradient so as to decrease with change in position in the direction in which the hammer assembly extends (the direction from the front side toward the back side when viewed from the player in the state in which the hammer assembly is assembled to the keyboard apparatus, and the direction reverse to the D3 direction in FIG. 3). Thus, the depth of the recessed portion 236 (T1-T2) also decreases with change in position in the direction in which the hammer assembly extends (the direction from the front side toward the back side when viewed from the player in the state in which the hammer assembly is assembled to the keyboard apparatus, and the direction reverse to the D3 direction in FIG. 3). However, the present disclosure is not limited to this, and the distance T2 in the region in the thickness direction may be different among the plurality of the recessed portions 236 as long as the distance T2 is less than the distance T1 of the other region in the thickness direction. That is, the distance T2 in the region of the recessed portion 236 in the thickness direction may be zero. In other words, the recessed portion 236 may be a through hole (the wording "hole portion" may be used in the case where no distinction is provided between the recessed portion and the through hole). Since the recessed portion 236 can be adjusted in depth and size (the area), it is possible to adjust the volume of the recessed portion 236 minutely.

In the present embodiment, the recessed portion 236 is configured so as to be surrounded with the region with the distance T1 in the thickness direction. However, the present disclosure is not limited to this, and the recessed portion 236 may be disposed at an end portion of the weight 230 as long as the outer shape of the weight 230 is not changed. In this case, the distance in the thickness direction at the end portion of the weight 230 at which the recessed portion 236 is disposed is equal to the distance T2 in the region of the recessed portion 236 in the thickness direction.

Like the first recessed portions 236*a* disposed nearer to the pivot center of the hammer assembly 200, the second recessed portions 236*b* of the weights 230*wl* which are disposed nearer to the rear end portion 212 of the hammer assembly 200 have different size (areas) when viewed in the direction of the assembly of the weight 230 to the hammer body portion 205 (the pivot-shaft direction and the D1 direction in FIG. 3). That is, the size of a second recessed portion 236*b*17 of the weight 230*wl*17 (the area (the opening area) of the recessed portion of the second recessed portion 236*b*17 when viewed in the direction in which the pivot shaft extends) is different from that of a second recessed portion 236*b*25 of the weight 230*wl*25. Since the different weights 230 have the recessed portions 236 of the different shapes (the number, the size, the depth, or the like) at different positions, the different weights 230 have the different masses and the different centers of gravity. That is, since the different weights 230 have the recessed portions 236 with the different shapes at different positions, it is possible to control the mass and the center of gravity C of the hammer assembly 200. While the first recessed portions 236*a*2, 236*a*17, 236*a*25 have different shapes, and the second recessed portions 236*b*17, 236*b*25 have different shapes in the present embodiment, the present disclosure is not limited to this configuration. For example, all the second recessed portions 236*b* formed in the weights 230*wl* may be different from each other in shape in addition to making all the first recessed portions 236*a* formed in the weights 230*wl* different from each other in shape. The keyboard apparatus may be configured such that the first recessed portions 236*a* formed in at least two of the weights 230*wl* are different from each other in shape, and the second recessed portions 236*b* formed in at least two of the weights 230*wl* are different from each other in shape. The keyboard apparatus may be configured such that the first recessed portions 236*a* formed in at least two of the weights 230*wl* have the same shape, and at least two second recessed portions 236*b* formed in the two weights 230*wl* are different from each other in shape. The keyboard apparatus may be configured such that the second recessed portions 236*b* formed in at least two of the weights 230*wl* have the same shape, and two first recessed portion 236*a* formed in the two weights 230*wl* are different from each other in shape. That is, in two of the plurality of weights 230*wl*, as long as at least ones of: the first recessed portions 236*a*; and the two second recessed portion 236*b* are different from each other in shape, the two weights 230*wl* are different from each other in weight. While the second recessed portions 236*b* are formed in at least the two weights 230*wl*17, 230*wl*25 of the weights 230*wl* in FIGS. 10C and 10D, the keyboard apparatus may be configured such that none of the weights 230*wl* has the second recessed portions 236*b*, and at least two of the weights 230*wl* have the first recessed portions 236*a*, and these first recessed portions 236*a* are different from each other in shape. That is, the weights of the respective weights 230*wl* may be adjusted by the size of each of the first recessed portions 236*a*. Likewise, the keyboard apparatus may be configured such that none of the weights 230*wl* has the first recessed portions 236*a*, and at least two of the weights 230*wl* have the second recessed portions 236*b*, and these second recessed portions 236*b* are different from each other in shape. In this case, the weights of the respective weights 230*wl* are adjusted by the size of each of the second recessed portions 236*b*. While the weights 230*wl* illustrated in FIGS. 10A-10D corresponding to the white keys 100*w*, these weights 230*wl* may be replaced with the weights 230 corresponding to the black keys 100*b*. In the case where the weights 230*wl* are replaced as described above, the weights 230 corresponding to the black keys 100*b* may not include the weights each including both of the first recessed portion 236*a* and the second recessed portion 236*b*. That is, the weights 230 corresponding to the black keys 100*b* may include at least one weight having one recessed portion 236 (e.g., a first recessed portion 230*a*) but not include a weight having two recessed portions 236 (the first recessed portion 230*a* and a second recessed portion 230*b*). The weights 230 corresponding to the black keys 100*b* may include the weight 230 not having any of the recessed portions 236 as illustrated in FIG. 10A.

Each of the weights 230*wl* has the recessed portions 236 at its opposite end portions in the direction in which the hammer assembly extends (the D3 direction in FIG. 3), making it possible to concentrate the distribution of the weight of the weight 230*wl* on a position near the center of the weight 230*wl*. If the distribution of the weight of the weight 230*wl* disperses, a large mass is required even in the case of the same static load and dynamic load. Since the distribution of the weight of the weight 230*wl* is concentrated on a position near the center of the weight 230*wl* in the present embodiment, it is possible to adjust the static load and the dynamic load independently within a predetermined range of the mass. Since the different weights 230*wl* have the recessed portions 236 with the different shapes at different positions as described above, the mass of the weight 230*wl* can work for the moment of inertia of the hammer assembly 200 more effectively. The moment of inertia of the hammer assembly 200 determines a dynamic load of the keyboard apparatus which will be described below.

Figure 11:
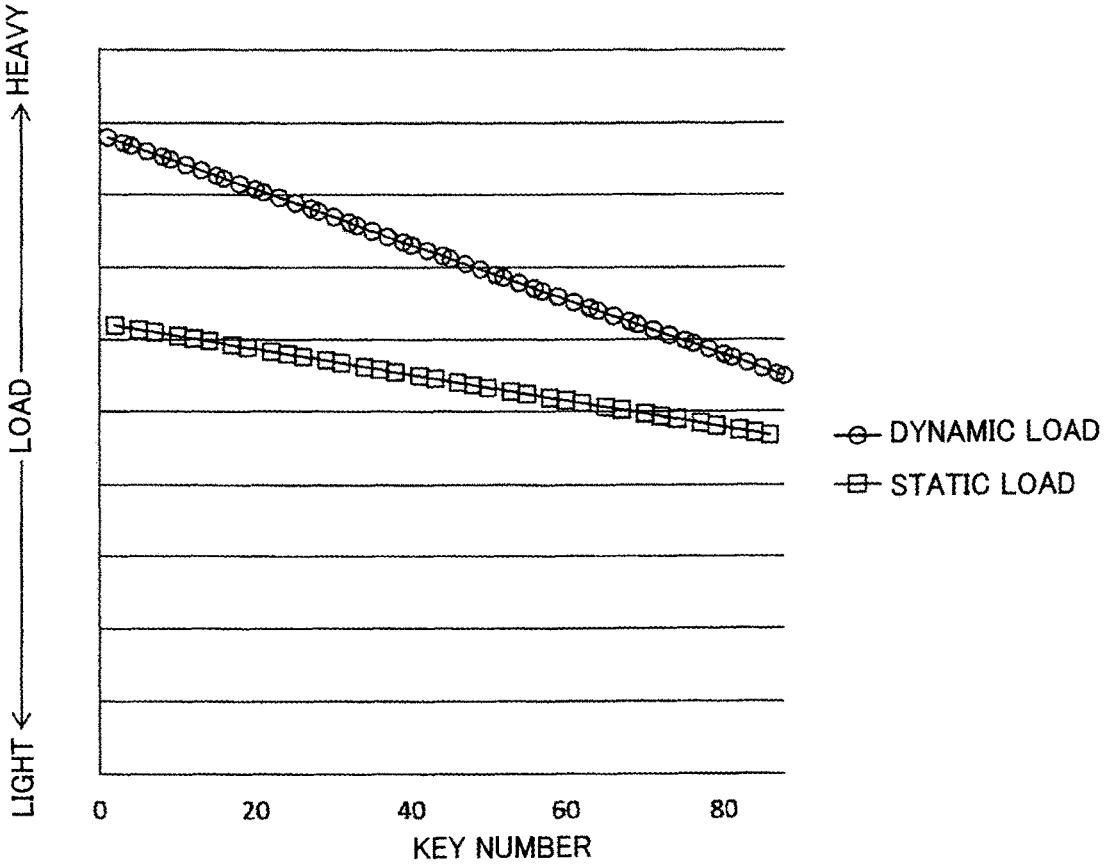
FIG. 11 is a view illustrating a relationship between the pitch corresponding to each key and each of a static load and a dynamic load of the weight in the one embodiment.

FIG. 11 is a view representing a relationship between the pitch corresponding to each key and each of a static load and a dynamic load of the weight in the one embodiment. As illustrated in FIG. 11, the weights 230 corresponding to the respective keys respectively have different static loads, and the static load decreases from the low-pitched sound portion toward the high-pitched sound portion in order of pitch. The static load of the weight 230 with respect to the pitch always changes linearly at the constant rate from the low-pitched sound portion to the high-pitched sound portion. However, the present disclosure is not limited to this, and the static load of the weight 230 with respect to the pitch may be constant and may change nonlinearly. The weights 230 corresponding to the respective keys respectively have different dynamic loads, and the dynamic load decreases from the low-pitched sound portion toward the high-pitched sound portion in order of pitch. The dynamic load of the weight 230 with respect to the pitch always changes linearly at the constant rate from the low-pitched sound portion to the high-pitched sound portion. However, the present disclosure is not limited to this, and the dynamic load of the weight 230 with respect to the pitch may change nonlinearly and may be constant.

In the pivot member according to the present embodiment as described above, the position at which the weight 230 is mounted on the hammer body portion 205 and the shape and the position of the recessed portion 236 in the weight 230 are adjusted, making it possible to control the moment about the pivot center applied from gravity to the hammer assembly 200 and the moment of inertia and to design the static loads and the dynamic loads stepwise from the low-pitched sound portion toward the high-pitched sound portion through the white keys and the black keys.

As illustrated in FIGS. 8A-8C, the distance between the first screw through hole (a fastening-member mount portion) 272 corresponding to the first screw 271 and the second screw through hole (the fastening-member mount portion) 274 corresponding to the second screw 273 is different among the weight 230*wl*, the weight 230*wh*, and the weight 230*b* to prevent wrong connection of the weight 230 to the hammer body portion 205. In this example, the distance Lwb3 from the first screw through hole 272 to the second screw through hole 274 in the weight 230*b* corresponding to the black key is adjusted so as to be less than each of the distances Lwwl3, Lwwh3 from the first screw through hole 272 to the second screw through hole 274 in a corresponding one of the weights 230*wl*, 230*wh* corresponding to the white keys. The distances Lwwl3, Lwwh3 between the first screw through hole 272 and the second screw through hole 274 is the same between the weight 230*wl* corresponding to the low-pitched-sound white key and the weight 230*wh* corresponding to the high-pitched-sound white key. The distance between the first screw through hole 272 and the second screw through hole 274 is the same among the weights 230 corresponding to the keys of the same color, i.e., among the weights 230 corresponding to the white keys or the black keys. However, the present disclosure is not limited to this, and the distance from the first screw through hole 272 to the second screw through hole 274 may be reversed between each of the weight 230*wl* and the weight 230*wh* corresponding to the white keys and the weight 230*b* corresponding to the black key. The number of the screw through holes may be different between each of the weight 230*wl* and the weight 230*wh* corresponding to the white key and the weight 230*b* corresponding to the black key. Each of the hammer body portions 205 corresponding to the respective weights 230 at least needs to have the screw holders corresponding to the distance and/or the number of the screw holes. Since the weight 230 and the hammer body portion 205 respectively have the screw through holes and the screw holders corresponding to each combination, it is possible to prevent wrong connection between the weight 230 and the hammer body portion 205, resulting in improved productivity. As illustrated in FIGS. 10C and 10D, the first screw through hole 272 may be formed at the region in the recessed portion 236. Likewise, the second screw through hole 274 may be formed at the region in the recessed portion 236.

Method of Manufacturing Weight

Figure 12A:
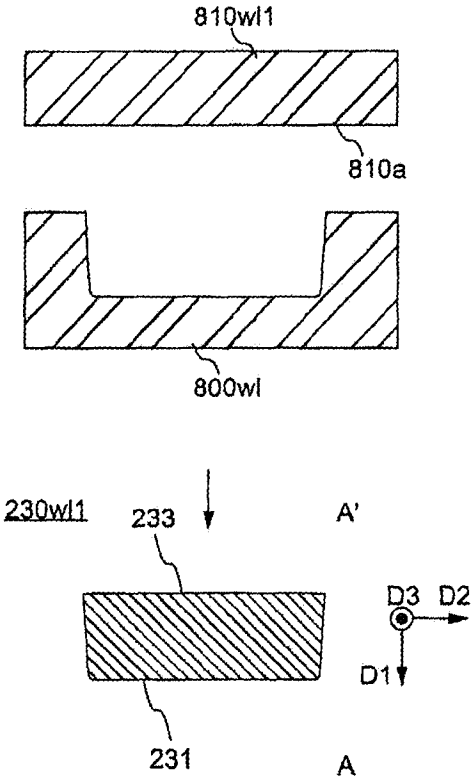
FIGS. 12A through 12C are schematic views for explaining a method of manufacturing the weight in the one embodiment.
Figure 12B:
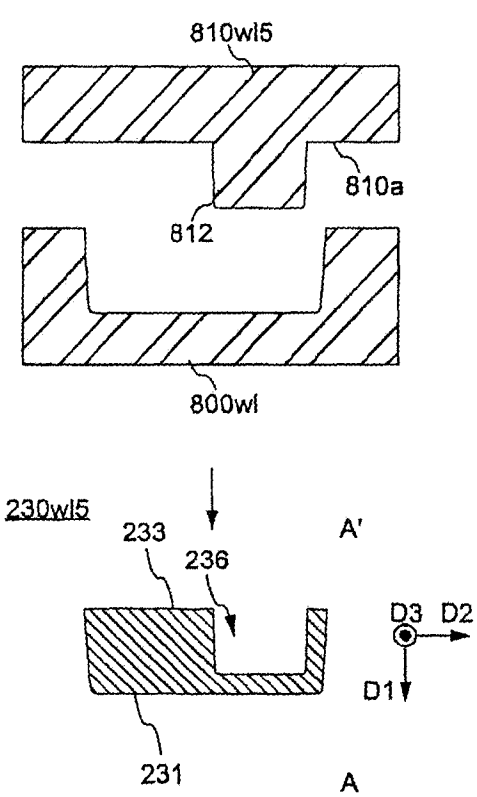
Figure 12C:
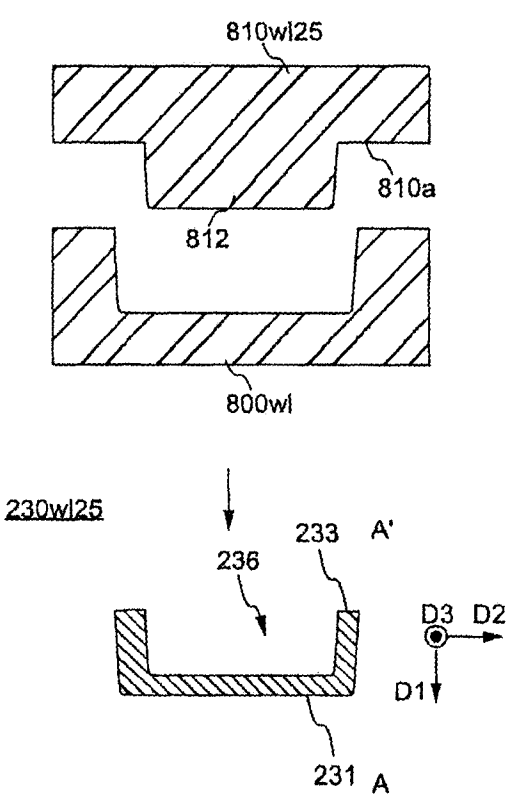

There will be next described a method of manufacturing the weight with reference to FIGS. 12A-120. FIGS. 12A-120 are schematic views of a metal mold for molding the weight 230, and the weight 230 in the one embodiment of the present invention. FIG. 12A is a view of metal molds 800*wl*, 810*wl*1 for molding the weight 230*wl*1 corresponding to the lowest-pitched-sound white key, and the weight 230*wl*1. FIG. 12B is a cross-sectional schematic view of metal molds 800*wl*, 810*wl*5 for molding a weight 230*wl*5 corresponding to the low-pitched-sound-side fifth white key, and the weight 230*wl*5. FIG. 12C is a cross-sectional schematic view of metal molds 800*wl*, 810*wl*25 for molding a weight 230*wl*25 corresponding to the low-pitched-sound-side twenty-fifth white key, and the weight 230*wl*25.

The metal mold for forming the weight 230 includes a first metal mold 800*wl* and second metal mold 810*wl*1, 810*wl*5, 800*wl*25. The first metal mold 800*wl* is a mold for the external dimension of the weight 230. A surface 810*a* of the second metal mold 810*wl*1 is a mold for the surface 233 opposed to the connecting surface 231 of the weight 230. That is, the first metal mold 800*wl* forms the connecting surface 231 of the weight 230 and surfaces 235, 237 (see FIGS. 7A-7B) thereof continuing to the connecting surface 231, and the second metal mold 810*wl*1 forms the surface 233 and a surface 238 of the weight 230. In the present embodiment, the external dimension of the weight 230 can be classified into three types. Thus, three types of the first metal molds 800*wl* are required for the weight 230*wl* corresponding to the low-pitched-sound white key, the weight 230*wh* corresponding to the high-pitched-sound white key, and the weight 230*b* corresponding to the black key. The recessed portion 236 corresponding to each of the weight 230 and corresponding to a protruding Portion 812 of each of the second metal molds 810*wl*5, 810*wl*25 is formed in the surface 233 opposed to the connecting surface 231 of the weight 230. Thus, eighty-eight types of second metal molds are required for eighty-eight types of the weights 230. In the present embodiment, the first metal mold 800*wl* of three types are used to manufacture the eighty-eight types of the weights 230, resulting in lower manufacturing cost of the metal mold and a simpler process of manufacturing the weight 230 than in the case where the first metal mold and the second metal mold are produced for each pitch to manufacture the weight.

The first metal mold 800*wl* and the second metal molds 810*wl*1, 810*wl*5, 810*wl*25 for forming the weight 230 have a draft angle for releasing the weight 230 from the metal mold without deformation. Thus, the weight 230 also has a draft angle. In the weight 230 in this example, the external dimension of the surface 233 opposed to the connecting surface 231 is greater than that of the connecting surface 231. In other words, the perimeter of the surface 233 opposed to the connecting surface 231 is greater than the perimeter of the connecting surface 231 of the weight 230.

However, the configurations of the first metal mold and the second metal molds for forming the weight 230 are not limited to these. For example, the first metal mold may be a mold for the external dimension and the surface 233 opposed to the connecting surface 231. In this case, the first metal mold further includes, at a bottom portion of its recessed portion determining the external dimension: a first protruding portion corresponding to the recessed portion 236 of each of the weights 230; and a second protruding portion corresponding to the surface 238. Thus, eighty-eight types of the first metal molds are required. In the present embodiment, the second metal molds of a single type is required to manufacture the eighty-eight types of the weights 230. In the weight 230 to be manufactured, the external dimension of the surface 233 opposed to the connecting surface 231 is less than the external dimension of the connecting surface 231 due to the draft angle of the first metal mold. With this configuration, only the single type of the second metal mold is required to manufacture the eighty-eight types of the weights 230, resulting in a much simpler process of manufacturing the weight 230.

Operations of Keyboard Assembly

Figure 13A:
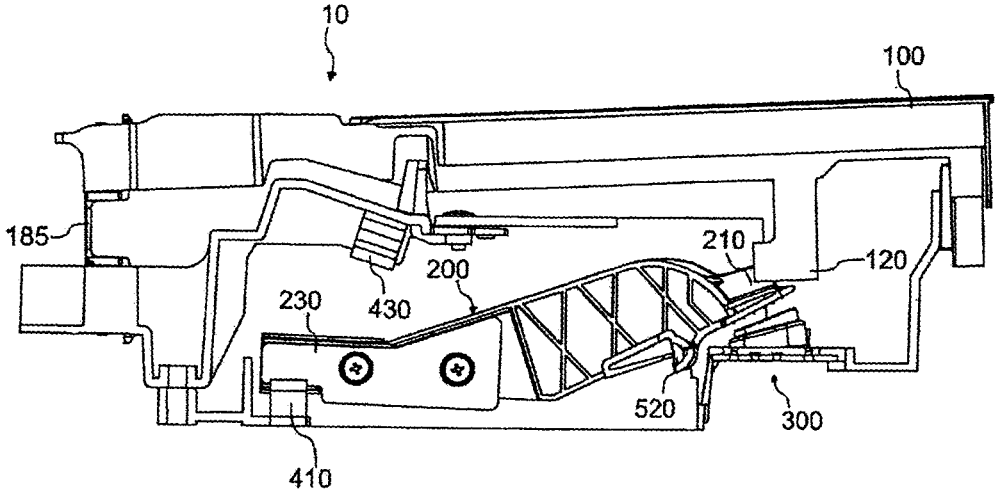
FIGS. 13A and 13B is a view for explaining operations of the keyboard assembly when the key (a white key) is depressed in the one embodiment.
Figure 13B:
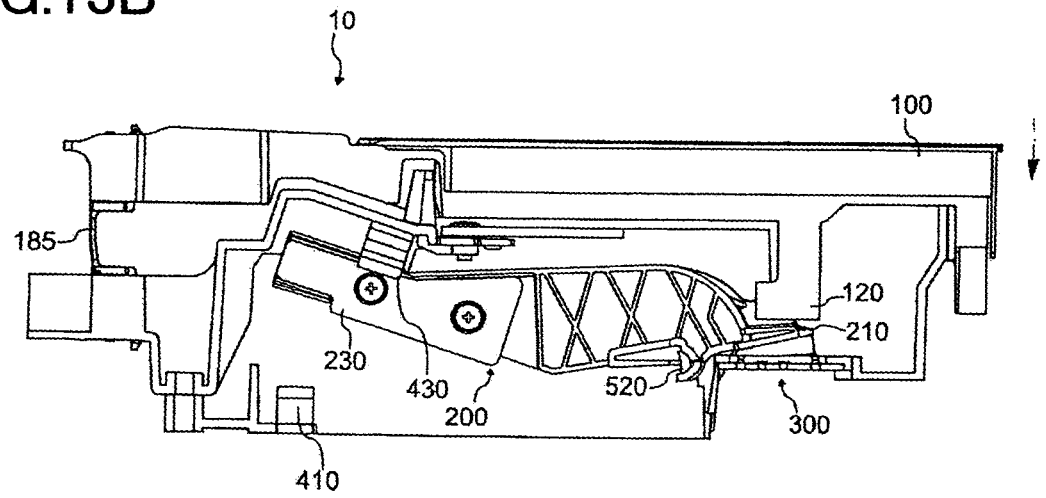

FIGS. 13A and 13B are view for explaining operations of the key assembly when the key (the white key) is depressed in the one embodiment. FIG. 13A is a view illustrating a state in which the key 100 is located at a rest position (that is, the key is not depressed). FIG. 13B is a view illustrating a state in which the key 100 is located at an end position (that is, the key is fully depressed). When the key 100 is pressed, the rod-like flexible member 185 is bent as a pivot center. In this state, the front-end key guide 151 and the side-surface key guide 153 inhibit the key 100 from moving in the front and rear direction, and thereby the key 100 pivots in the up and down direction (the pivotal direction). In response, the hammer supporter 120 depresses the front end portion 210, causing pivotal movement of the hammer assembly 200 about the pivot shaft 520. When the weight 230 collides with the upper stopper 430, the pivotal movement of the hammer assembly 200 is stopped, and the key 100 reaches the end position. When the sensor 300 is pressed by the front end portion 210, the sensor 300 outputs the detection signals in accordance with a plurality of levels of an amount of pressing of the sensor 300 (i.e., the key pressing amount).

When the key is released, the weight 230 moves downward by gravity, the hammer assembly 200 pivots. In response, the front end portion 210 presses the hammer supporter 120 upward, causing upward pivotal movement of the key 100. When the weight 230 comes into contact with the lower stopper 410, the pivotal movement of the hammer assembly 200 is stopped, and the key 100 is returned to the rest position.

In the above-described embodiment, the electronic piano is taken as one example of the keyboard apparatus to which the hammer assembly is applied. The pivot member in the above-described embodiment is not limited to this and may be applied to a hammer assembly of a keyboard mechanism of an acoustic musical instrument in which a sound generator such as a string and a musical bar is struck by a hammer in response to an operation of a key to produce a sound. Alternatively, the pivot member in the above-described embodiment may be applied to a component constituting an action mechanism of a keyboard apparatus as long as the component has a configuration different from that of another component in accordance with pitch. For example, the weight in the above-described embodiment may be applied to a pivot mechanism of a jack or a support of an action mechanism of a keyboard instrument, which pivot mechanism includes a pivot component and a supporter configured to support the pivot component pivotably.

Each of the hammer body portion and the weight is constituted by a single component in the above-described embodiment but may be constituted by a plurality of components. For example, the bearing of the hammer body portion may be provided independently. In this case, a plurality of types of bearing components may be prepared to provide a plurality of types of hammer body portions to each of which a corresponding one of the bearing components is assembled, with the hammer body portion other than the bearing component being common. While both of the first hole portion and the second hole portion of the weight are different in shape among the pitches of the keys as illustrated in the figures in the above-described embodiment, at least one of the first hole portion and the second hole portion at least needs to be different.

It is to be understood that the invention is not limited to the illustrated embodiment, but may be embodied with various changes and modifications without departing from the spirit and scope of the disclosure. For example, while the hammer assembly is driven by the key in the above-described embodiment, the present disclosure is not limited to this. For example, the hammer assembly may be driven by another action member (e.g., a jack or a support of an action mechanism of an acoustic piano). A supporter for the pivot shaft, a portion for receiving a force from another component, a portion for driving the sensor, and the placement of the weight as a configuration of the hammer assembly are not limited to those in the above-described embodiment and at least needs to be designed as needed in accordance with the configuration of the keyboard. All the functions of the hammer assembly in the present embodiment are not necessarily provided, and the configuration in this case may be designed as needed. For example, in the case where the key drives the sensor, a portion for driving the sensor may be omitted. In the above-described embodiment, the hammer body portion and the weight are independent of each other, with the hammer assembly serving as the pivot member, but the hammer body portion and the weight may be formed as a single hammer.

What is claimed is:

1. A keyboard apparatus comprising:

a frame;

a plurality of keys each disposed pivotably with respect to the frame;

a plurality of pivot members, including a first pivot member and a second pivot member, each comprising:

a support member disposed pivotably about a pivot shaft; and a weighted member connected to the support member at a position spaced apart from the pivot shaft, the weighted member having a specific gravity that is greater than that of the support member, wherein:

a first weighted member, corresponding to the weighted member of the first pivot member, includes a first hole portion and a second hole portion, a second weighted member, corresponding to the weighted member of the second pivot member, includes a third hole portion and a fourth hole portion, a mass of the first weighted member and a mass of the second weighted member are different from each other, and the first hole portion and the third hole portion are different from each other in shape, and the second hole portion and the fourth hole portion are different from each other in shape, so that a position of a center of gravity of the first weighted member is different from a position of a center of gravity of the second weighted member.

2. The keyboard apparatus according to claim 1, wherein at least one of the first, second, third, or fourth hole portion is a recessed portion that is not formed through the respective first or second weighted member in a thickness direction.

3. The keyboard apparatus according to claim 1, wherein the area of the first or second hole portion is different from the area of the third or fourth hole portion, respectively when viewed in a direction in which the pivot shaft extends.

4. The keyboard apparatus according to claim 1, wherein:

the first hole portion is located at a first distance from the pivot shaft, the second hole portion is located at a second distance from the pivot shaft, and the second distance is greater than the first distance.

5. The keyboard apparatus according to claim 4, wherein:

the first hole portion includes at least a portion of a region located nearer to the pivot shaft than the center of gravity of the first weighted member, and the second hole portion includes at least a portion of a region located on an opposite side of the center of gravity of the first weighted member from the pivot shaft.

6. The keyboard apparatus according to claim 4, wherein:

a first key corresponding to the first pivot member and a second key corresponding to the second pivot member are identical in color, and a position of a fastening-member mount portion for a fastening member configured to fasten the support member and the weighted member to each other is identical between the first pivot member and the second pivot member.

7. The keyboard apparatus according to claim 4, wherein:

at least one of the first, second, third, or fourth hole portion is a recessed portion that is not formed through the respective first or second weighted member, each of the plurality of pivot members further comprises a fastening-member mount portion for a fastening member configured to fasten the support member and the weighted member to each other, and at least part of the first hole portion is located nearer to the pivot shaft than the fastening-member mount portion is to the pivot shaft.

8. The keyboard apparatus according to claim 4, wherein:

at least one of the first, second, third, or fourth hole portion is a recessed portion that is not formed through the respective first or second weighted member, each of the plurality of pivot members further comprises a fastening-member mount portion for a fastening member configured to fasten the support member and the weighted member to each other, and at least part of the second hole portion is located farther from the pivot shaft than the fastening-member mount portion is to the pivot shaft.

9. The keyboard apparatus according to claim 4, wherein:

a key corresponding to the first pivot member is a white key, and a key corresponding to the second pivot member is a black key, among the plurality of keys, and the first weighted member and the second weighted member are different from each other in mount position in a longitudinal direction of the respective support member.

10. The keyboard apparatus according to claim 1, wherein the weighted member is connected to the support member from a side in a direction different from a longitudinal direction of the support member.

11. The keyboard apparatus according to claim 1, wherein the weighted member is connected to the support member from a side in the pivot-shaft direction.

12. The keyboard apparatus according to claim 1, wherein:

at least one of the first, second, third, or fourth hole portion is a recessed portion that is not formed through the respective first or second weighted member, and each of the plurality of pivot members further comprises a fastening-member mount portion for a fastening member configured to fasten the support member and the weighted member to each other.

13. A keyboard apparatus comprising:

a frame;

a plurality of keys each disposed pivotably with respect to the frame;

a plurality of pivot members, including a first pivot member and a second pivot member, each comprising:

a support member disposed pivotably about a pivot shaft; and a weighted member connected to the support member at a position spaced apart from the pivot shaft, the weighted member having a specific gravity that is greater than that of the support member, wherein:

a first weighted member, corresponding to the weighted member of the first pivot member, includes a first hole portion and a second hole portion, a second weighted member, corresponding to the weighted member of the second pivot member, includes a third hole portion and a fourth hole portion, a mass of the first weighted member and a mass of the second weighted member are different from each other, and an area of the first hole portion is different from an area of the third hole portion, and an area of the second hole portion is different from an area of the fourth hole portion when viewed in a direction in which the pivot shaft extends, so that a position of a center of gravity of the first weighted member is different from a position of a center of gravity of the second weighted member.

* * * * *